US006502293B1

(12) United States Patent
Khurana

(10) Patent No.: US 6,502,293 B1
(45) Date of Patent: Jan. 7, 2003

(54) TOOLING FOR CAMSHAFT GEAR REMOVAL

(75) Inventor: Ram B. Khurana, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/710,350

(22) Filed: Nov. 9, 2000

(51) Int. Cl.[7] ..... B23P 19/00
(52) U.S. Cl. ..... 29/426.5; 29/260; 29/266
(58) Field of Search ..... 29/256, 258, 259, 29/260, 261, 262, 263, 264, 265, 266, 426.5

(56) References Cited

U.S. PATENT DOCUMENTS

| | | | | | |
|---|---|---|---|---|---|
| 1,026,548 | A | * | 5/1912 | Allien | 29/252 |
| 1,064,400 | A | * | 6/1913 | Timmins | 29/259 |
| 1,227,457 | A | | 5/1917 | Langan | |
| 1,258,699 | A | | 3/1918 | Neumaier | |
| 1,310,447 | A | | 7/1919 | Schilling | |
| 1,343,661 | A | * | 6/1920 | Brower | 29/261 |
| 1,352,990 | A | * | 9/1920 | Reinker | 29/261 |
| 1,368,760 | A | * | 2/1921 | Schilling | 29/260 |
| 1,381,142 | A | * | 6/1921 | Staley | 29/261 |
| 1,394,129 | A | * | 10/1921 | Wickersham | 29/261 |
| 1,409,506 | A | * | 3/1922 | Willis | 29/261 |
| 1,417,265 | A | * | 5/1922 | McClarran | 29/263 |
| 1,435,397 | A | * | 11/1922 | Hunt | 29/261 |
| 1,439,611 | A | * | 12/1922 | Coston | 29/261 |
| 1,446,918 | A | * | 2/1923 | Mielke | 29/261 |
| 1,447,768 | A | * | 3/1923 | Dover et al. | 29/261 |
| 1,456,735 | A | * | 5/1923 | Hunt | 29/261 |
| 1,457,841 | A | * | 6/1923 | Johnson | 29/261 |
| 1,462,437 | A | * | 7/1923 | Young | 29/261 |
| 1,470,310 | A | * | 10/1923 | Winchell | 29/261 |
| 1,478,648 | A | | 12/1923 | Grahek | |
| 1,485,733 | A | * | 4/1924 | Sterling et al. | 29/261 |
| 1,494,832 | A | | 5/1924 | Grant | |
| 1,522,983 | A | | 1/1925 | Strassner | |
| 1,559,885 | A | * | 11/1925 | Kelley | 29/260 |
| 1,566,673 | A | * | 12/1925 | Heinrich | 29/261 |
| 1,584,855 | A | * | 5/1926 | Eisenhuth | 29/261 |
| 1,607,592 | A | * | 11/1926 | Marciano et al. | 29/259 |
| 1,631,872 | A | * | 6/1927 | Knight | 29/258 |
| 1,644,839 | A | * | 10/1927 | Landrum | 29/261 |
| 1,708,355 | A | * | 4/1929 | Chipman | 29/261 |
| 1,709,913 | A | * | 4/1929 | Kaplan | 29/261 |
| 1,715,506 | A | * | 6/1929 | Livesay | 29/261 |
| 1,721,189 | A | * | 7/1929 | Schekall et al. | 29/252 |
| 1,787,016 | A | * | 12/1930 | Opel | 29/261 |
| 1,787,070 | A | * | 12/1930 | Hainsworth | 29/259 |
| 1,828,252 | A | * | 10/1931 | Lynch | 29/252 |
| 1,866,654 | A | * | 7/1932 | Kulp et al. | 29/261 |
| 1,879,331 | A | * | 9/1932 | Kulp et al. | 29/261 |
| 2,003,648 | A | * | 6/1935 | Frye et al. | 29/252 |
| 2,052,534 | A | * | 8/1936 | Quarles | 29/261 |
| 2,077,254 | A | * | 4/1937 | Nestler | 29/259 |
| 2,161,227 | A | | 6/1939 | Houston | 29/85 |
| 2,252,036 | A | | 8/1941 | Rummer | 29/86 |

(List continued on next page.)

FOREIGN PATENT DOCUMENTS

| | | |
|---|---|---|
| DK | 18533 | 3/1914 |

*Primary Examiner*—Gregory M. Vidovich
*Assistant Examiner*—Essama Omgba
(74) *Attorney, Agent, or Firm*—Woodard, Emhardt, Naughton, Moriarty & McNett LLP

(57) ABSTRACT

A kit of tooling components for facilitating removal of a gear from a shaft includes a plurality of jaw members that are adapted to fit through blanking holes defined in the gear. The jaw members are further adapted to engage the gear. The kit further includes a set of studs with each of the studs adapted to engage one of the jaw members and a plate adapted to couple to the studs. The kit further includes a jack adapted to engage and fit between the plate and the shaft. Included as a part of this disclosure is a method of removing a camshaft gear by use of the kit of tooling components.

29 Claims, 20 Drawing Sheets

U.S. PATENT DOCUMENTS

| | | | | | |
|---|---|---|---|---|---|
| 2,468,970 | A | * | 5/1949 | Gilbertson | 29/259 |
| 2,834,100 | A | * | 5/1958 | Harsh | 29/261 |
| 2,872,728 | A | * | 2/1959 | Fraser | 29/256 |
| 2,992,478 | A | * | 7/1961 | Baker | 29/259 |
| 3,146,522 | A | * | 9/1964 | Wright | 29/256 |
| 3,200,483 | A | * | 8/1965 | Menegoni | 29/259 |
| 3,689,978 | A | | 9/1972 | Kelso | 29/259 |
| 3,696,496 | A | | 10/1972 | Corder | 29/260 |
| 3,908,258 | A | | 9/1975 | Barty | 29/252 |
| 4,034,458 | A | * | 7/1977 | Ford et al. | 29/259 |
| 4,042,139 | A | | 8/1977 | Pernsteiner et al. | 214/331 |
| 4,868,965 | A | * | 9/1989 | Drymon | 29/259 |
| 5,333,378 | A | * | 8/1994 | Sjobom | 29/898.08 |
| 5,894,650 | A | * | 4/1999 | Barenburg | 29/259 |
| 5,983,474 | A | * | 11/1999 | Koppe | 29/261 |
| 6,012,211 | A | * | 1/2000 | Ochoa et al. | 29/426.5 |
| 6,305,061 | B1 | * | 10/2001 | King | 29/259 |

* cited by examiner

TOOLING FOR CAMSHAFT GEAR REMOVAL

BACKGROUND OF THE INVENTION

The present invention generally relates to the removal of camshaft gears that are associated with high power diesel engines, and more specifically, but not exclusively, concerns tooling components that are used to facilitate the removal of such camshaft gears from camshafts.

Typical camshaft gears for high horse powered diesel engines have to transmit very high torque to a camshaft. Such camshafts routinely have to sustain variable loads imposed on the camshaft by modern high-pressure injection systems and valve train actuating mechanisms. These high variable loads require the camshaft-gear assembly to be assembled with a high interference fit between the camshaft and the camshaft gear. In one method of assembly, the camshaft gear is shrunk fit onto the camshaft in order to create the high interference fit.

Removal of such tightly fitted camshaft gears from the camshaft can be problematic for mechanics in rebuild/field workshops. One problem is that an engine compartment for these types of diesel engines can be small and movement within the compartment can be restricted. This can make removal of the camshaft gear within the engine compartment rather difficult. One solution to this problem is to remove the entire camshaft-gear assembly from the engine before the camshaft gear is removed from the camshaft. This camshaft removal method can be, however, quite labor intensive.

To further complicate matters, traditional tooling generally has problems with gripping the camshaft gear. One way to improve the tool grip is to machine numerous threaded holes into the camshaft gear. These holes can be machined when the gear is initially manufactured or afterwards during gear removal. When the gear is removed, the tooling is secured to the threaded holes. One problem is that machining of these holes can create additional labor costs, and the threading in the holes can be prone to stripping.

These threaded holes usually are not machined in the same location for different types and sizes of gears. One solution is to use separate tooling to remove each type of gear. However, this solution can create storage and cost problems. Another solution is to make gear attachment bolts of the tooling slidable along a base plate. One problem associated with this solution is that a mechanic must ensure that these bolts are properly aligned between the camshaft gear and the base plate. If the bolts are improperly aligned, a large amount of shear stress will form on the bolts, and this can lead to a catastrophic failure of the tooling.

As will be clear from the following description, the present invention improves the removal procedure for removal of camshaft gears from camshafts in a novel and unobvious manner by providing an easier procedure and one which is safer and faster to perform.

SUMMARY OF THE INVENTION

A kit of tooling components for facilitating removal of a gear having blanking holes from a shaft according to one embodiment of the present invention comprises a plurality of jaw members which are constructed and arranged to fit through the blanking holes of the gear and to engage the gear, a jack which is constructed and arranged to exert force on the shaft, a plate which is constructed and arranged to brace the jack, and a set of studs which are constructed and arranged to transmit force exerted on the plate by the jack onto the jaw members.

In a related embodiment of the present invention, a method of removing a gear having blanking holes from a shaft is disclosed. The method of removing the gear includes providing a kit of tooling components that include a plurality of jaw members, a plurality of studs, a plate, and a jack. The studs are coupled to the jaw members, and the jaw members are inserted through the blanking holes in the gear. The jack is aligned with the shaft. The studs are attached to the plate with the jack being positioned between the plate and the shaft. The gear is removed from the shaft by extending the jack.

One object of the present invention is to provide a kit of tooling components that facilitate an improved procedure for removing a camshaft gear from a camshaft.

Related objects and advantages of the present invention will be apparent from the following description.

DESCRIPTION OF THE PREFERRED EMBODIMENTS

Figure 1:
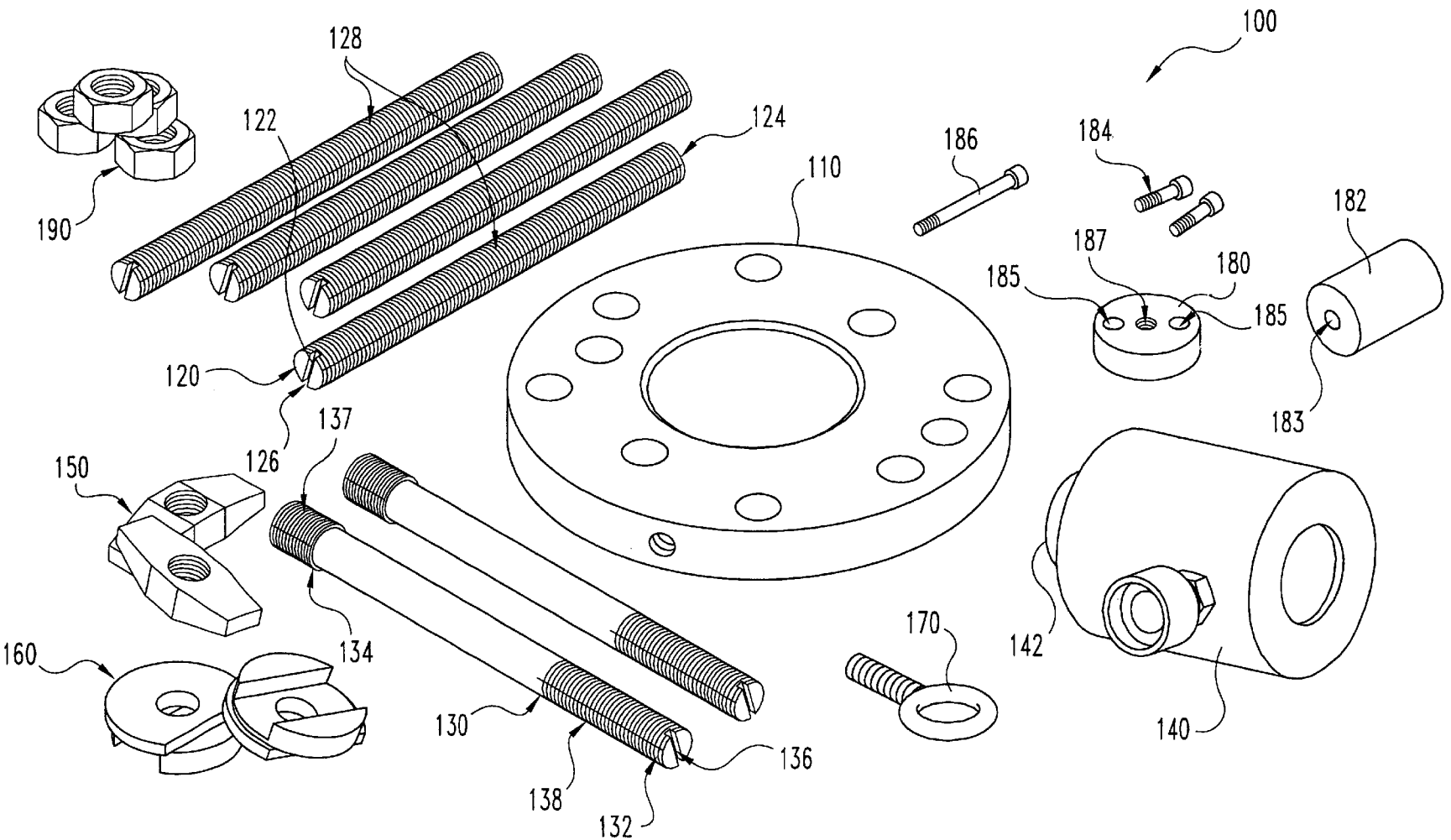
FIG. 1 is a perspective view of a tooling component kit for removing of camshaft gears according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as described herein being contemplated as would normally occur to one skilled in the art to which the invention relates. One embodiment of the invention is shown in great detail, although it will be apparent to those skilled in the art that some of the features which are not relevant to the invention may not be shown for the sake of clarity. While the present invention is described in reference to camshafts and camshaft gears, it should be appreciated that the present invention is also applicable to other types of gears and shafts.

Referring now to FIG. 1, there is illustrated a tooling kit 100 that is designed to be used for the removal of a camshaft gear from a camshaft. Kit 100 includes a removal plate 110, four fully threaded studs 120, two partially threaded studs 130, a jack 140, two jaw members 150, two retainers 160, an eyebolt 170, a spacer base 180, a spacer 182, two spacer base capscrews 184, a spacer capscrew 186, and four nuts 190. Also included as part of the kit 100, although not illustrated, is an instruction manual for use with the components of the kit 100 during removal of camshaft gears. In the one embodiment, the jack 140 is a 30-ton hydraulic cylinder having a piston rod 142 slidably coupled thereto. It should be appreciated from the description below that the number of individual components can vary and/or certain components can be omitted depending on the requirements for removing a particular cams haft-gear assembly. For example, depending on the size of the camshaft-gear assembly and the jack 140, the spacer ba se 180 and the spacer 182 along with capscrews 184 and 186 can be omitted. As will be more fully described below, the fully threaded studs 120 and the partially threaded studs 130 can be alternatively used depending on the size of the mounting holes in the gear.

Each fully threaded stud 120 has a tool engaging end 122 and a fastening end 124. In the illustrated embodiment, the tool engaging end 122 has a slot 126 that is adapted to engage a tool, such as a screwdriver. It should be appreciated that the tool engaging end 122 can include other types of generally known tool engagements besides the illustrated slot 126. The fully threaded stud 120 has a threaded portion 128 that extends from the tool engaging end 122 to the fastening end 124.

Each partially threaded stud 130 has a tool engaging end 132 and a fastening end 134. In the illustrated embodiment, the partially threaded stud 130 has a tool engaging slot 136 defined therein. The fastening end 134 of the stud partially threaded 130 has a threaded portion 137 with an outer diameter that is larger than the remaining portion of the partially threaded stud 130. This larger outer diameter of the fastening end 134 allows the partially threaded stud 130 to engage larger diameter holes. The partially threaded stud 130 further has a threaded portion 138 at the tool engaging end 132. The thread pitch of threaded portions 137 and 138 can be the same or different. In one embodiment, the pitch of the threaded portion 137 of the fastening end 134 is different from the pitch of the threaded portion 138 of the tool engaging end 132. This allows the partially threaded stud 130 to be attached to a hole having a thread pitch different from the pitch of the threaded portion 138 of the tool engaging end 132.

In the embodiment illustrated in FIG. 1, the spacer base 180 and the spacer 182 both have a cylindrical shape. Defined in the spacer base 180 are a pair of spacer base receiving capscrew holes 185 that are adapted to receive the spacer base capscrews 184 and a threaded spacer capscrew hole 187 that is adapted to receive the spacer capscrew 186. The spacer 182 has defined therein a capscrew hole 183 that is adapted to receive the spacer capscrew 186.

Figure 2:
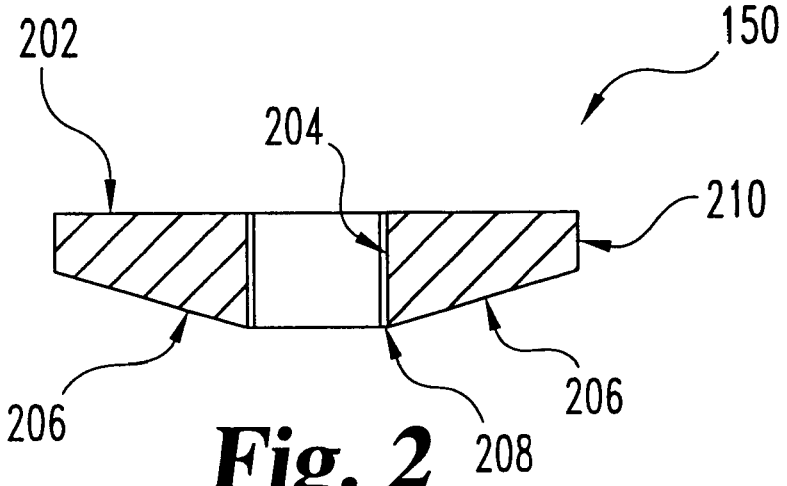
FIG. 2 is a front elevational view, in full section, of the jaw member shown in FIG. 1.

As shown in FIG. 2, the jaw member 150 has a substantially planar gear engaging surface 202. Jaw member 150 further has a threaded bore 204 defined therein that is adapted to threadedly receive the fully threaded stud 120 and/or the partially threaded stud 130. As illustrated, the jaw member 150 further has a pair of outwardly tapered portions 206. Each tapered portion 206 tapers from a bottom opening 208 of the threaded bore 204 to an outer edge 210 of the jaw member 150.

Figure 3:
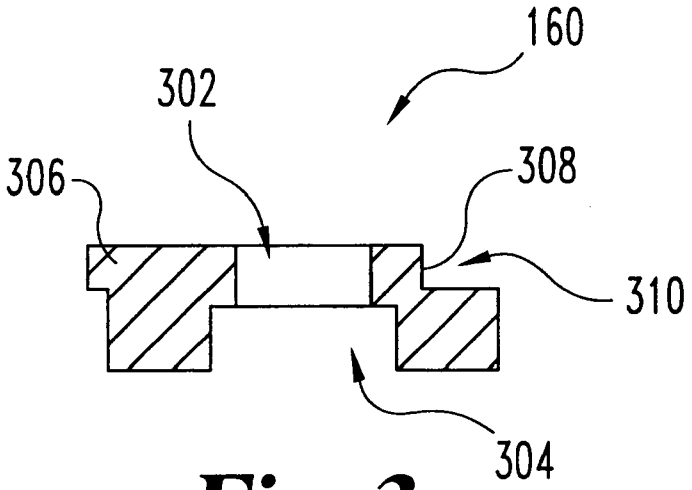
FIG. 3 is a front elevational view, in full section, of the retainer shown in FIG. 1.

A cross-sectional view of the retainer 160 is shown in FIG. 3. The retainer 160 has a stud receiving bore 302 and a jaw member receiving cavity 304 defined therein. The jaw member receiving cavity 304 is adapted to receive and engage at least a portion of the jaw member 150. The retainer 160 further has a retainer flange 306 extending therefrom. A substantially flat indicator face 308 extends along an indicator cavity 310 defined in the retainer 160. The indicator face 308 runs parallel to the jaw member receiving cavity 304 so as to indicate the orientation of the jaw member 150 when the jaw member 150 is engaged with the jaw member receiving cavity 304 in the jaw member 150.

Figure 4:
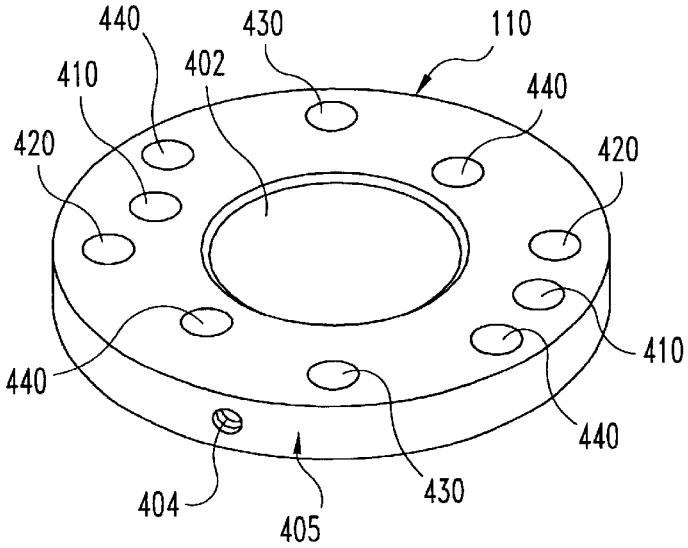
FIG. 4 is a perspective view of the removal plate shown in FIG. 1.

The removal plate 110, as shown in FIG. 4, has a jack receiving cavity 402 defined therein. In the illustrated embodiment, the jack receiving cavity 402 has a cylindrical shape in order to engage the jack 140, which also has a cylindrical shape. A threaded eyebolt engaging hole 404 is defined in an outer peripheral edge 405 of the plate 110. In the illustrated embodiment, the removal plate 110 has a cylindrical shape in order to reduce the overall size of the kit 100. Although the illustrated removal plate 110 has a cylindrical shape, it should be appreciated that the removal plate 110 can be shaped differently in order to fit inside a different engine compartment. Removal plate 110 has a number of sets of mounting holes 410, 420, 430, and 440 defined therein. Each set of mounting holes 410, 420, 430, and 440 is oriented in specific locations on the plate so that the kit 100 can engage different types (sizes) of gears. In the illustrated embodiment, the mounting holes 410, 420, 430, and 440 are unthreaded, and the nuts 190 are used to secure the studs 120 and 130 to the plate 110. In another embodiment, the mounting holes 410, 420, 430, and 440 are threaded such that the studs 120 and 130 can be directly secured to the plate 110.

Figure 5:
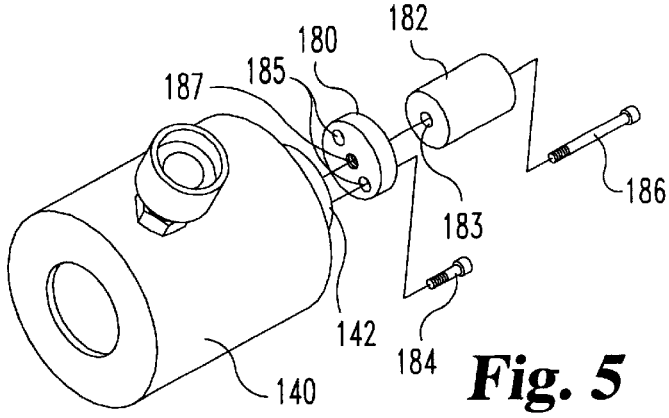
FIG. 5 is a perspective, exploded view of the jack, the spacer, and the spacer base shown in FIG. 1 illustrating one stage associated with a removal procedure according to the present invention.

One embodiment of a gear removal procedure according to the present invention will now be described with reference to FIGS. 5–16. As shown in FIG. 5, both spacer base capscrews 184 are inserted into the spacer base capscrew holes 185 in the spacer base 180 in order to fasten the spacer base 180 to the piston rod 142 of the jack 140. The spacer capscrew 186 is then inserted through the capscrew hole 183 in the spacer 182 and fastened in the threaded spacer capscrew hole 187 of the spacer base 180 in order to secure the spacer 182 to the spacer base 180. The spacer 182 along with spacer base 182 allows the jack 140 to engage smaller diameter camshafts. Some camshaft gears have camshaft holes that are too small to receive the piston rod 142. The spacer 182 has an outer diameter such that the spacer 182 can fit through these smaller camshaft holes. In addition, the spacer 182 along with the spacer base 180 can be used to reduce the effective distance between the jack 140 and a camshaft.

Figure 6:
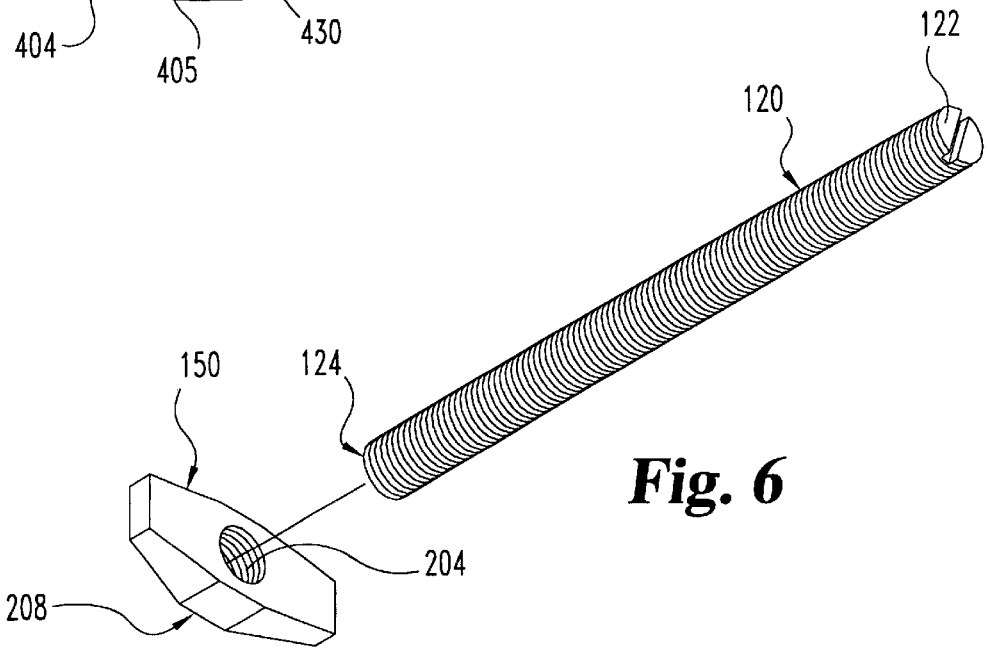
FIG. 6 is a perspective, exploded view of one jaw-stud assembly illustrating additional stages associated with the removal procedure according to the present invention.
Figure 7:
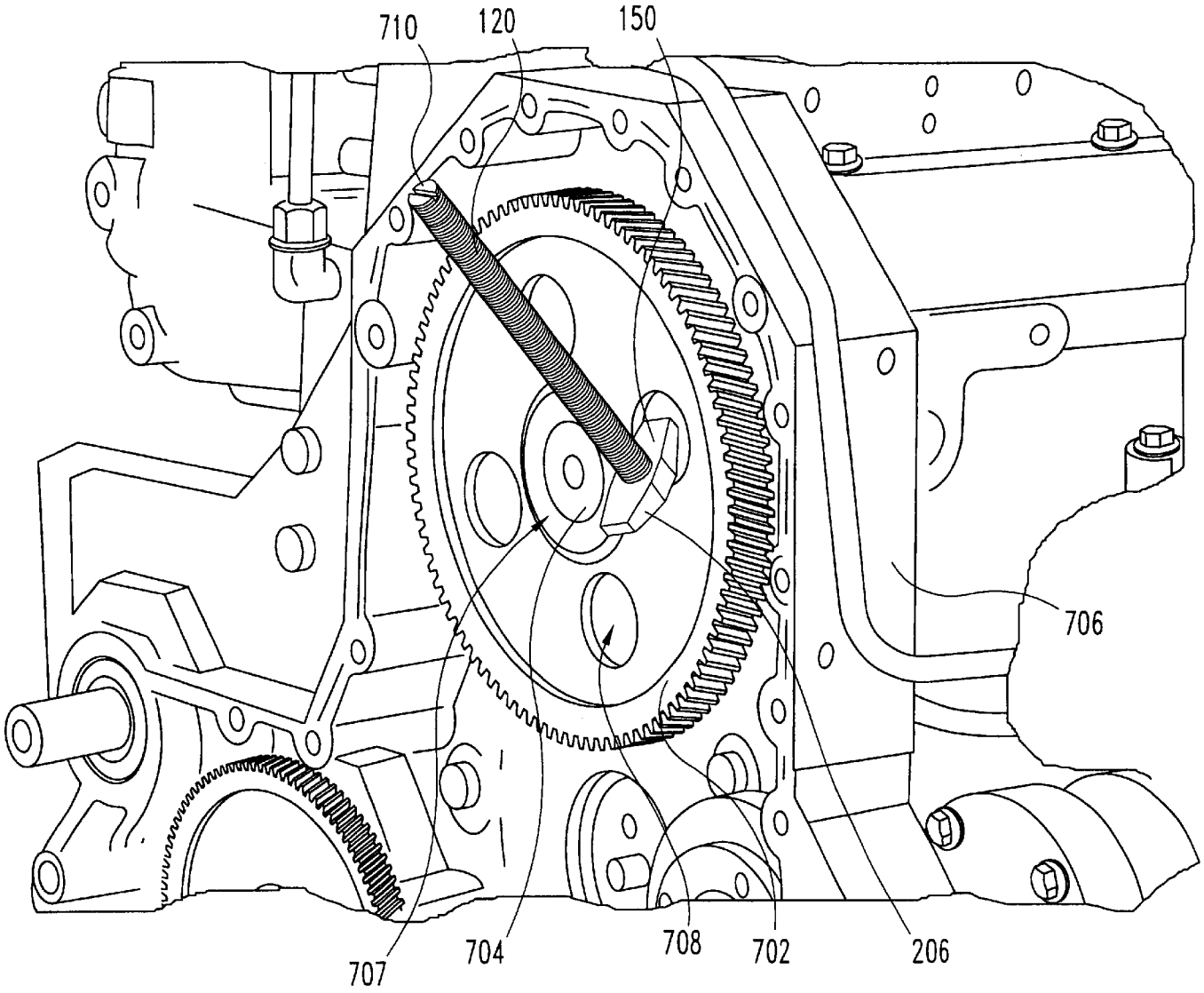
FIG. 7 is a perspective view of an engine illustrating additional stages associated with the removal procedure according to the present invention.

As depicted in FIG. 6, the fastening end 124 of the fully threaded stud 120 is then threaded into the threaded bore 204 of the jaw member 150 to create a jaw-stud assembly 710 (FIG. 7). To ensure that the stud 120 is properly secured, the stud 120 is threaded until the fastening end 134 of the stud 120 is flush with the bottom opening 208 of the jaw member 150.

An example of an environment in which the kit 100 can be used is illustrated in FIG. 7. A camshaft gear 702, which needs to be removed, is attached to a camshaft 704 of an engine 706. The camshaft gear 702 has a camshaft hole 707 in which the camshaft 704 is fitted. The gear 702 further includes a plurality of blanking holes 708 defined around the camshaft hole 707. These blanking holes 708 are typically formed when the camshaft gear 702 is initially manufactured and are used to lighten the weight of the gear 702.

After the jaw-stud assembly 710 is assembled, the jaw-stud assembly 710 is coupled to the camshaft gear 702. In the illustrated embodiment, two jaw-stud assemblies 710 are attached to opposite blanking holes 708. It should be appreciated that more than two jaw-stud assemblies 710 can also be used. In order to attach the jaw-stud assemblies 710, the jaw members 150 are angled to fit the jaw members 150 through the blanking holes 708. The tapered portions 206 of the jaw members 150 help the jaw members 150 to slide through the blanking holes 708.

Figure 8:
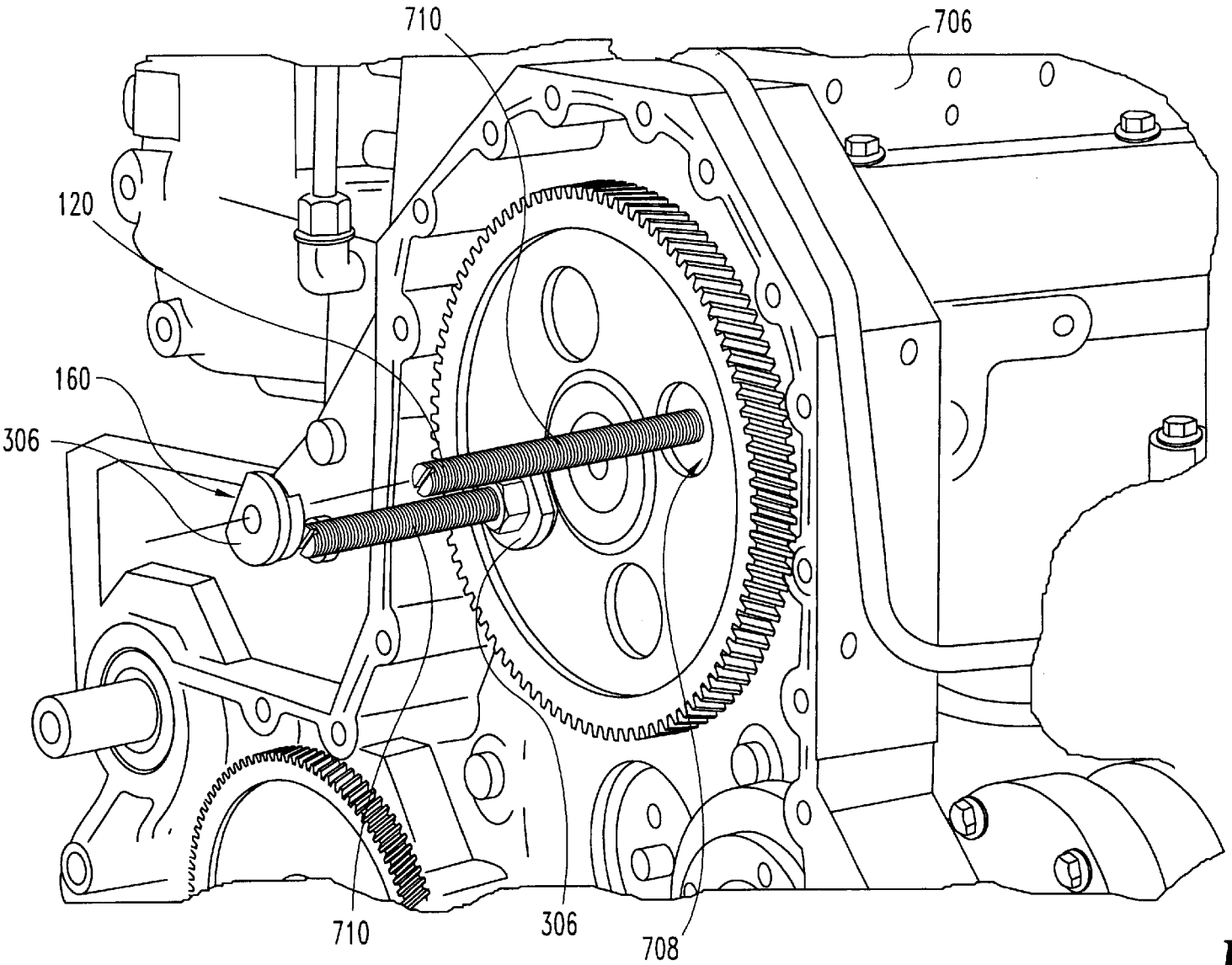
FIG. 8 is a perspective view of the jaw-stud assemblies attached to a camshaft gear illustrating additional stages associated with the removal procedure according to the present invention.
Figure 9:
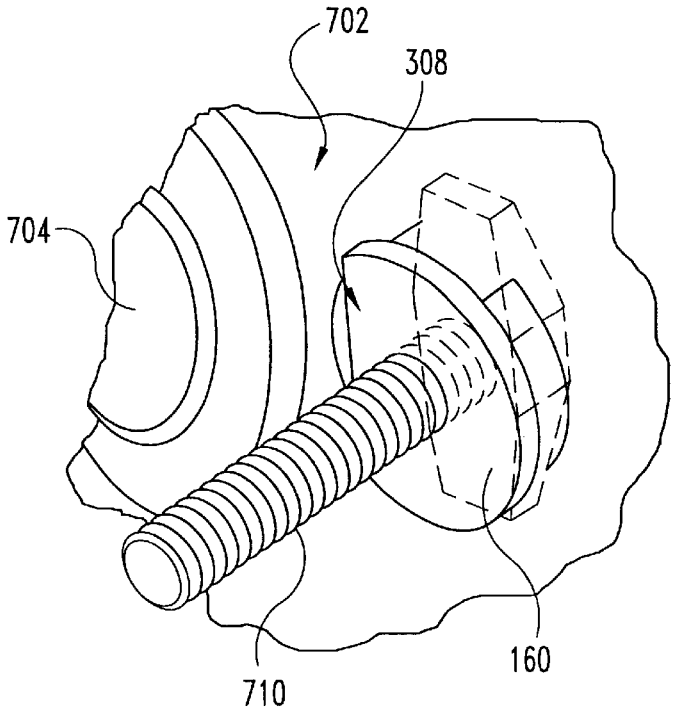
FIG. 9 is a perspective view of one of the jaw-stud assemblies aligned in a blanking hole of the camshaft gear illustrating additional stages associated with the removal procedure according to the present invention.
Figure 10:
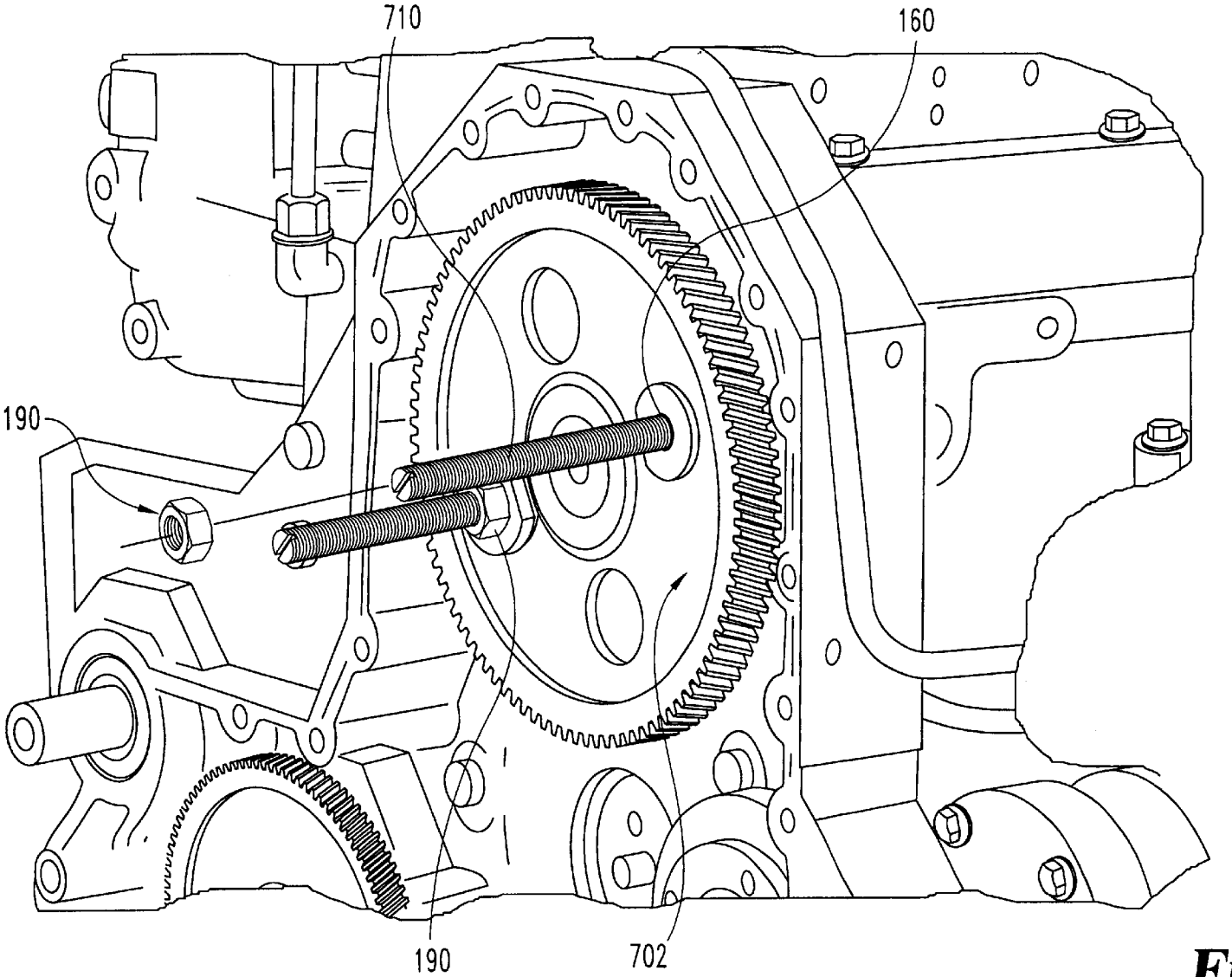
FIG. 10 is a perspective, exploded view of the jaw-stud assemblies along with the nuts shown in FIG. 1 illustrating additional stages associated with the removal procedure according to the present invention.

Afterwards, as illustrated in FIG. 8, each jaw-stud assembly 710 is centered within their respective blanking hole 708. One retainer 160 is slid along each of the studs 120 until the retainers 160 are positioned within the blanking holes 708. The retainer flanges 306 of the retainers prevent the retainers 160 from slipping through the blanking holes 708. The jaw members 150 are fitted into the jaw member cavities 304 in the retainers 160. As shown in FIG. 9, the flat indicator wall 308 of each retainer 160 is then rotated to face the camshaft 704. This ensures that the jaw members 150 are oriented properly on the back of the camshaft gear 702. Afterwards, as depicted in FIG. 10, one nut 190 is threaded onto each of the jaw-stud assemblies 710 and secured against a corresponding retainer 160 in order to secure the jaw-stud assemblies 710 to the camshaft gear 702.

Figure 12:
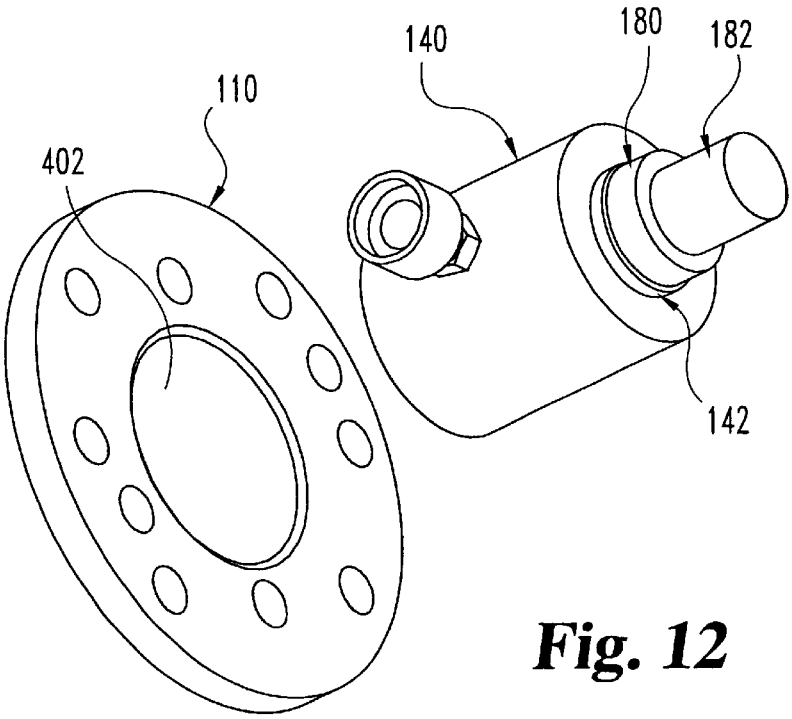
FIG. 12 is a perspective, exploded view of the removal plate and the jack illustrating additional stages associated with the removal procedure according to the present invention.
Figure 11:
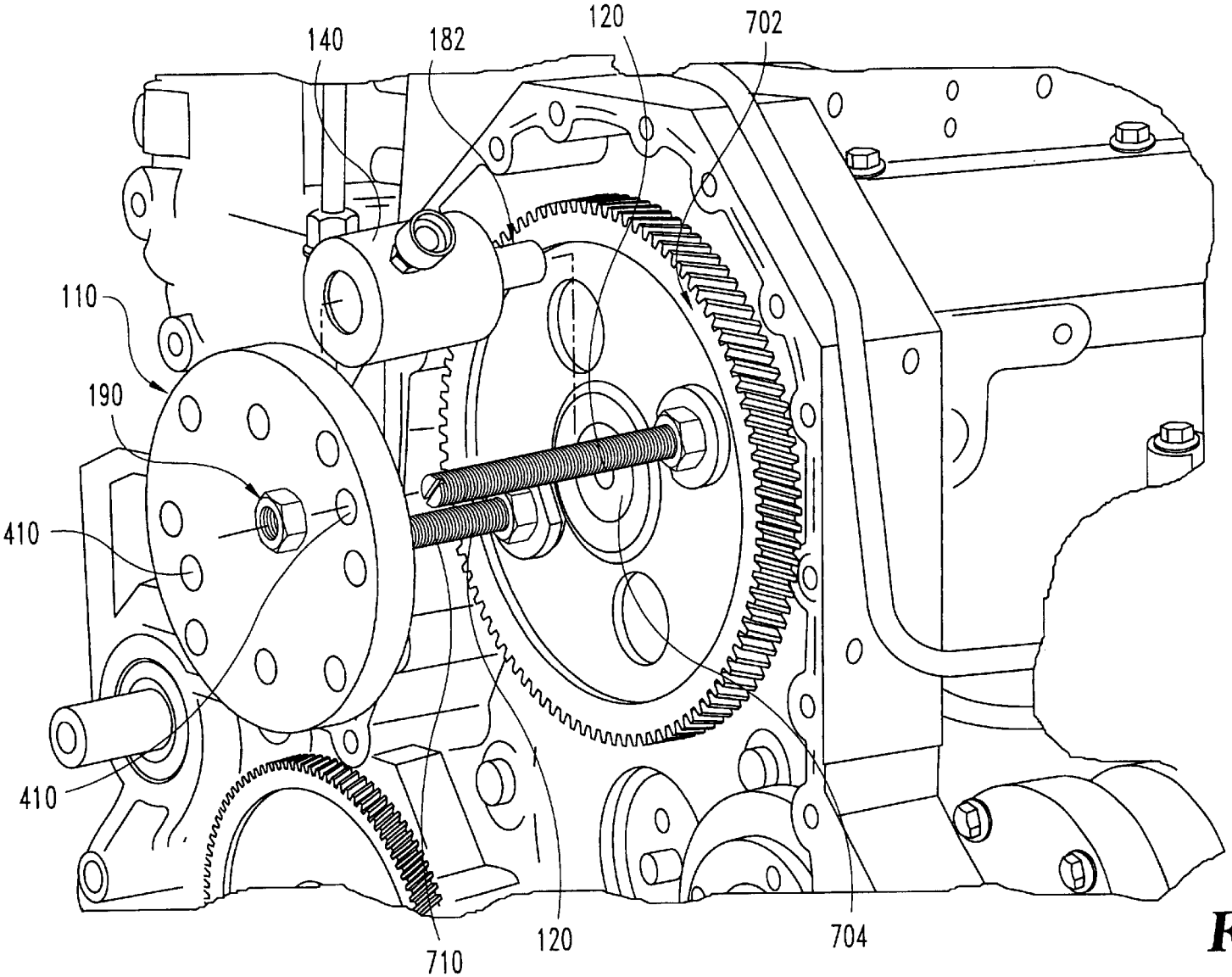
FIG. 11 is a perspective view of the engine along with the jack and the removal plate shown in FIG. 1 illustrating additional stages associated with the removal procedure according to the present invention.

After the jaw-stud assemblies 710 are secured, the jack 140 is centered and supported between the two studs 120 of the jaw-stud assemblies 710 (FIGS. 11–12). The plate 110 is then installed over the two studs 120 and against the jack 140. As shown in FIG. 12, the jack 140 is aligned to engage the jack receiving cavity 402 in the plate 110. When the studs 120 are fully inserted through the mounting holes 410, the nuts 190 are fastened to the studs 120 in order to secure the plate 110. Once the spacer 182 is centered over the camshaft 704, the nuts 190 are tightened. It should be appreciated that the studs 120 can be attached to the plate 110 in other manners as generally known by those skilled in the art.

Figure 13:
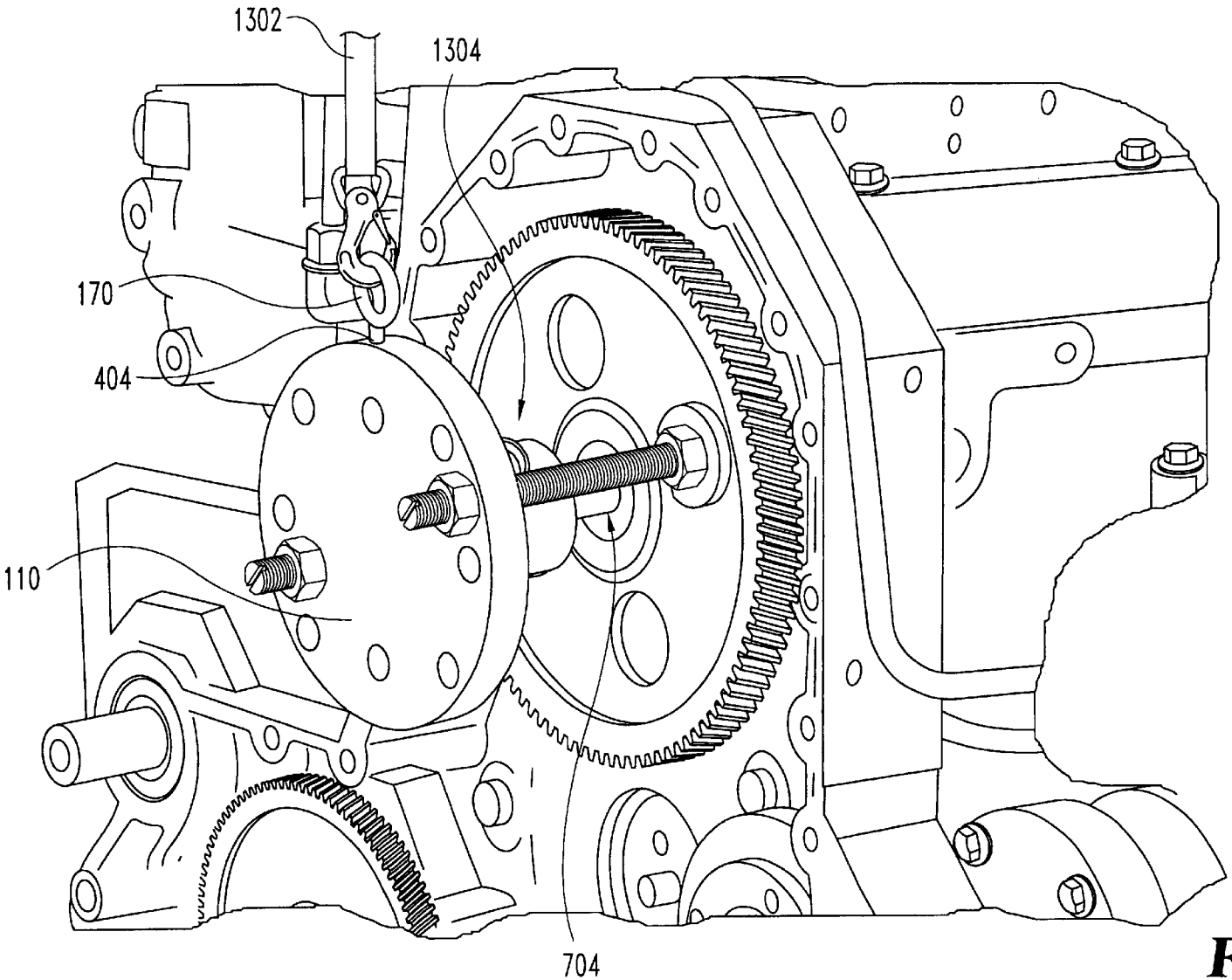
FIG. 13 is a perspective view of the assembled kit attached to the engine illustrating additional associated with the removal procedure according to the present invention.

As depicted in FIG. 13, the eyebolt 170 is then fastened to the threaded hole 404 in the plate 110, and a lifting device 1302 is secured to the eyebolt 170. The lifting device 1302 supports assembled kit 1304 when the camshaft gear 702 is removed. If necessary, the lifting device 1302 can slightly lift the assembled kit 1304 in order to align the assembled kit 1304 with the camshaft 704. In one embodiment, the lifting device 1302 includes a motor with a cable having an attachment hook.

Figure 14:
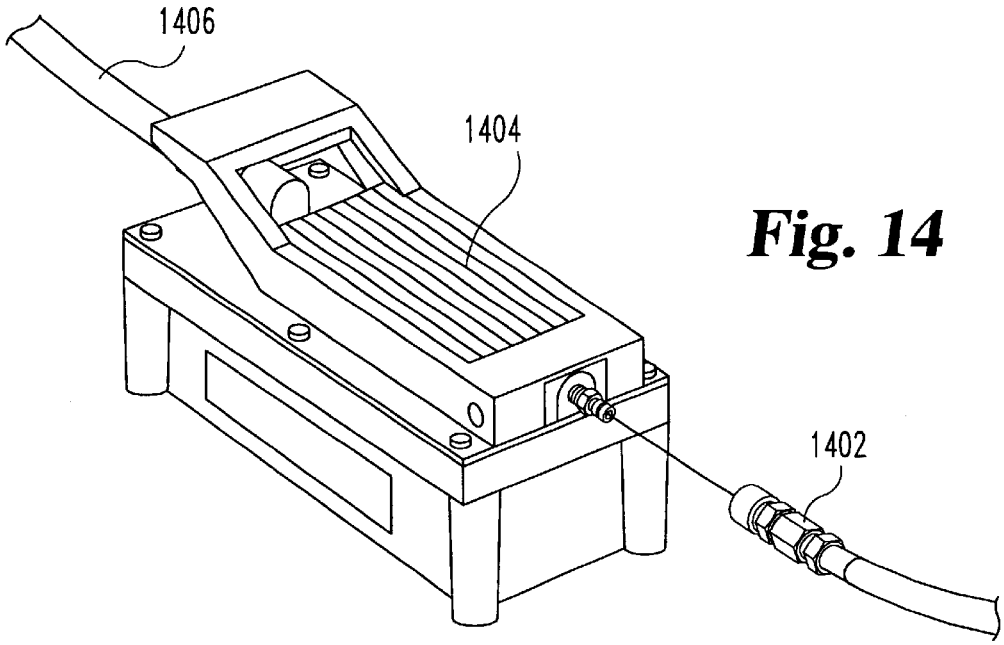
FIG. 14 is a perspective view of a pump illustrating additional stages associated with the removal procedure according to the present invention.
Figure 16:
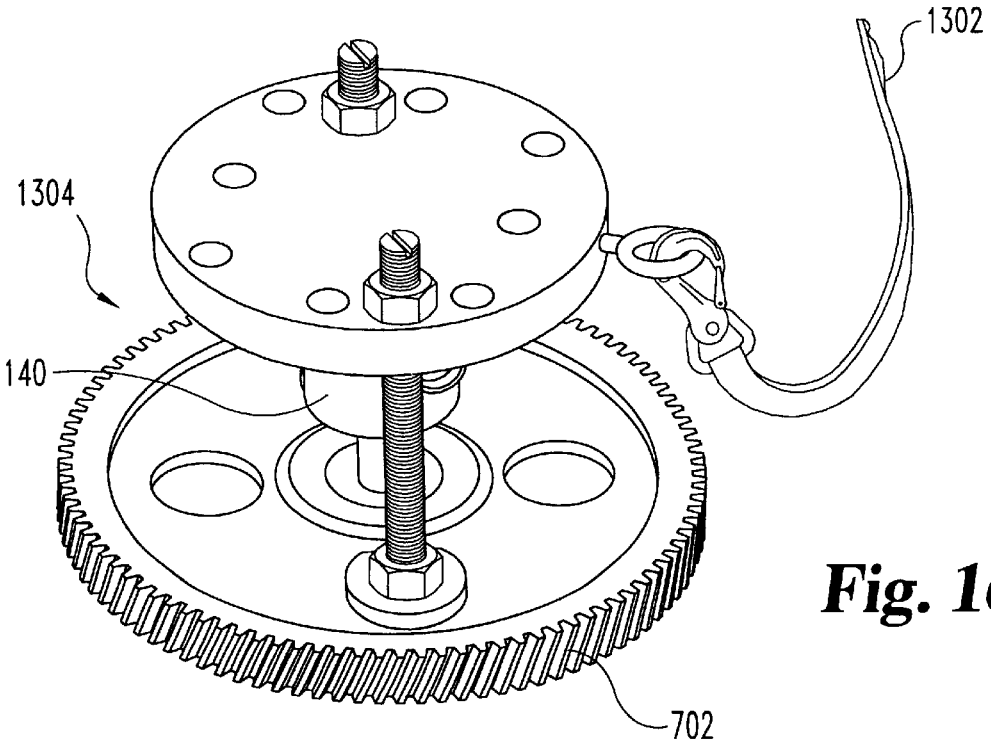
FIG. 16 is a perspective view of the assembled kit along with the removed gear illustrating additional stages associated with the removal procedure according to the present invention.
Figure 15:
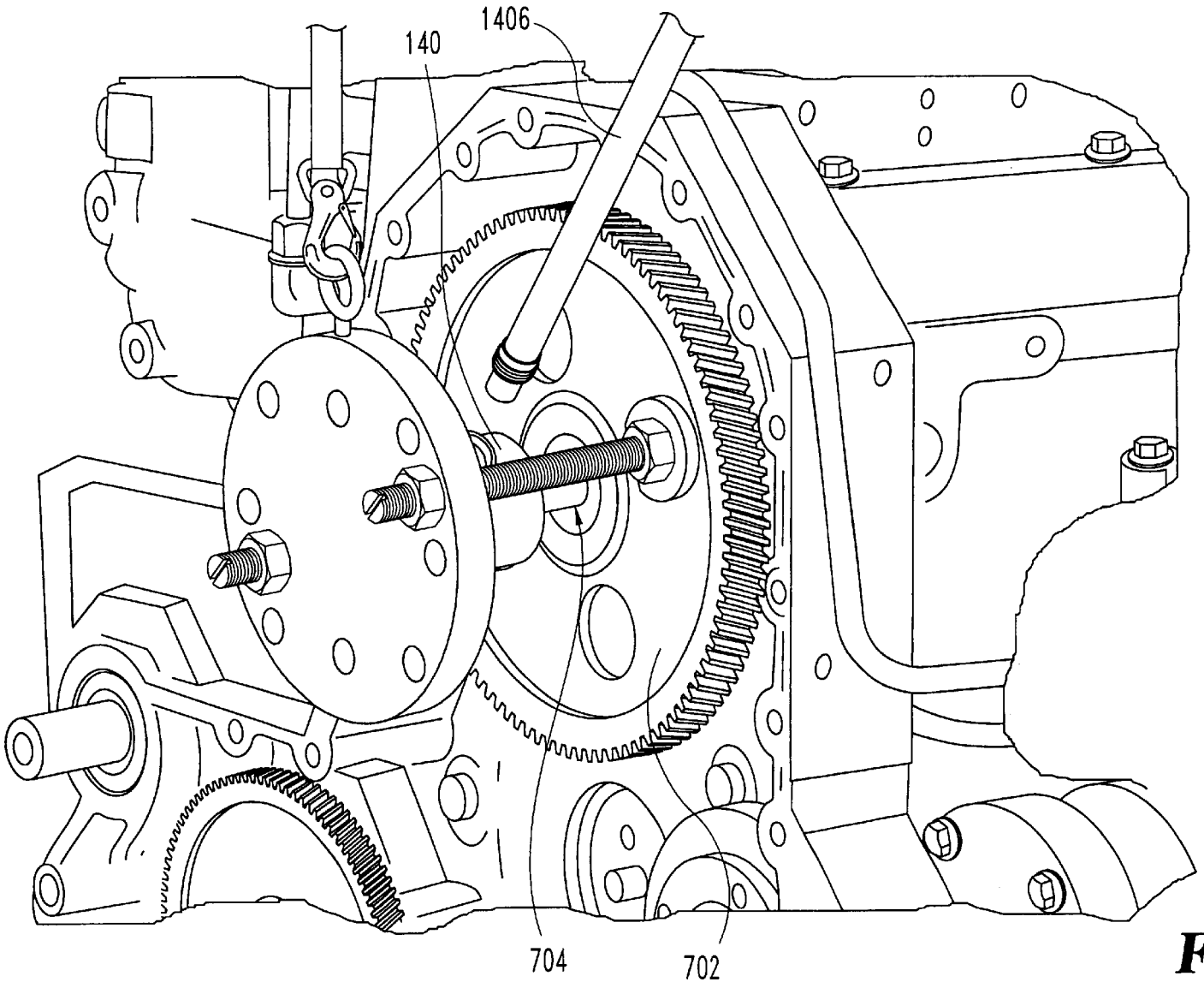
FIG. 15 is a perspective view of the assembled kit and the engine illustrating additional stages associated with the removal procedure according to the present invention.

Referring to FIG. 14, an air hose 1402 is coupled to an air/hydraulic pump 1404. The pump 1404 includes an output hydraulic hose 1406. As illustrated in FIG. 15, the output hydraulic hose 1406 of the pump 1404 is connected to the hydraulic jack 140. The pump 1404 is slowly operated until the spacer 182, which is attached to the jack 140, advances towards and rests against the camshaft 704. The alignment of the spacer 182 is then checked to ensure that the spacer 182 is centered on the camshaft 704. If the jack 140 is improperly aligned during removal of the gear 702, serious damage to the assembled kit 1304 and/or the gear 702 can occur. The pump 1404 continues to operate until the gear 702 is slid off the camshaft 704. As depicted in FIG. 16, the assembled kit 1304 and the gear 702 are removed as a single unit.

In order to reduce the possibility of damage to the jack 140, hydraulic pressure supplied by the pump 1404 is released as soon as the gear 702 is removed from the camshaft 704 in order to retract the piston rod 142 of the jack 140. After the gear 702 is removed, the hydraulic connection 1406 is also detached from the jack 140. The assembled kit 1304 is then disassembled in order to allow access to the camshaft gear 702. Once the removal of the camshaft gear 702 is completed, the kit 100 can be stored until needed for another similar task.

Figure 17:
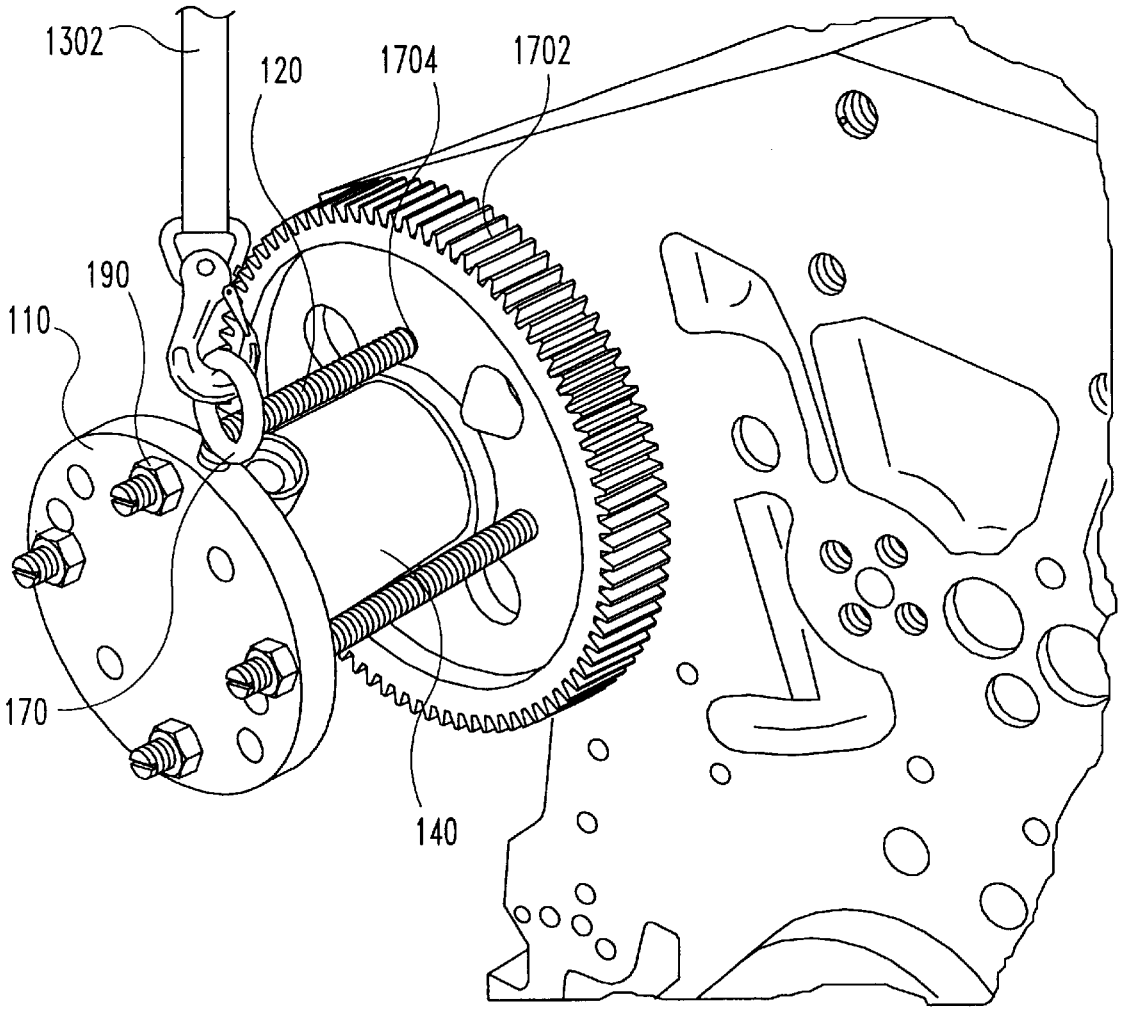
FIG. 17 is a perspective view of the kit assembled in another configuration showing one stage in a removal procedure according to another embodiment of the present invention.
Figure 18:
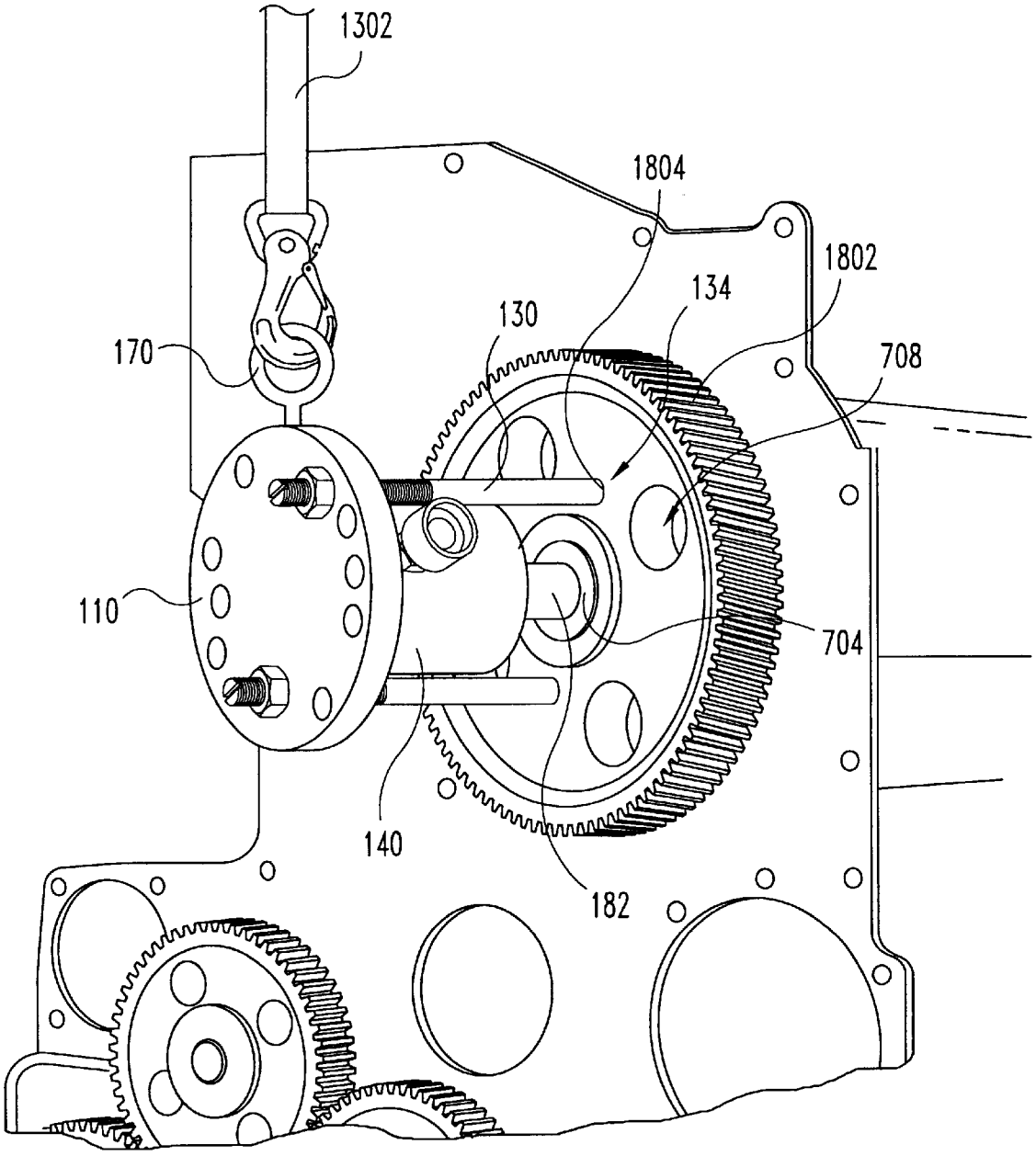
FIG. 18 is a perspective view of the kit assembled in still yet another configuration showing one stage in a removal procedure according to a further embodiment of the present invention.

The kit 100 according to the present invention can be adapted to be used to remove a wide variety of gears. An example of such adaptability is illustrated in FIGS. 17–18. In one embodiment shown in FIG. 17, a camshaft gear 1702 having four pre-machined threaded holes 1704 is attached to the camshaft 704 of the engine 706. In order to remove the gear 1702, four fully threaded studs 120 are threaded into the threaded mounting holes 1704 of the camshaft gear 1702. The fastening ends 124 of the studs 120 are positioned to be flush with the back of the gear 1702. As shown, the jack 140 in this particular embodiment does not have the spacer base 180 and the spacer 182 attached thereto. Nuts 190 are threaded onto the studs 120 to secure the jack 140 between the plate 110 and the gear 1702. The eyebolt 170 is secured to the plate 110, and the lifting device 1302 is then secured to the eyebolt 170. The jack 140 is energized in a manner as described above (see FIGS. 14–16) in order to remove the gear 1702 from the camshaft 704.

In another embodiment depicted in FIG. 18, a camshaft gear 1802 has two threaded holes 1804 with each having a diameter larger than the outer diameters of the fully threaded studs 120 and the tool engaging ends 132 of the partially threaded studs 130. The threaded portions 137 of the fastening ends 134 of studs have a sufficiently large outer diameter so as to engage the threaded holes 1804 in the camshaft gear 1802. The fastening ends 134 of two partially threaded studs 130 are fastened in the threaded holes 1804 in the gear 1802. Afterwards, the jack 140 with spacer 182 is secured between the gear 1802 and the plate 110 in a manner as described above. The lifting device 1302 is then secured to the eyebolt 170 that is attached to the plate 110. The jack 140 is then energized to remove the gear 1802 from the shaft 704.

Figure 19:
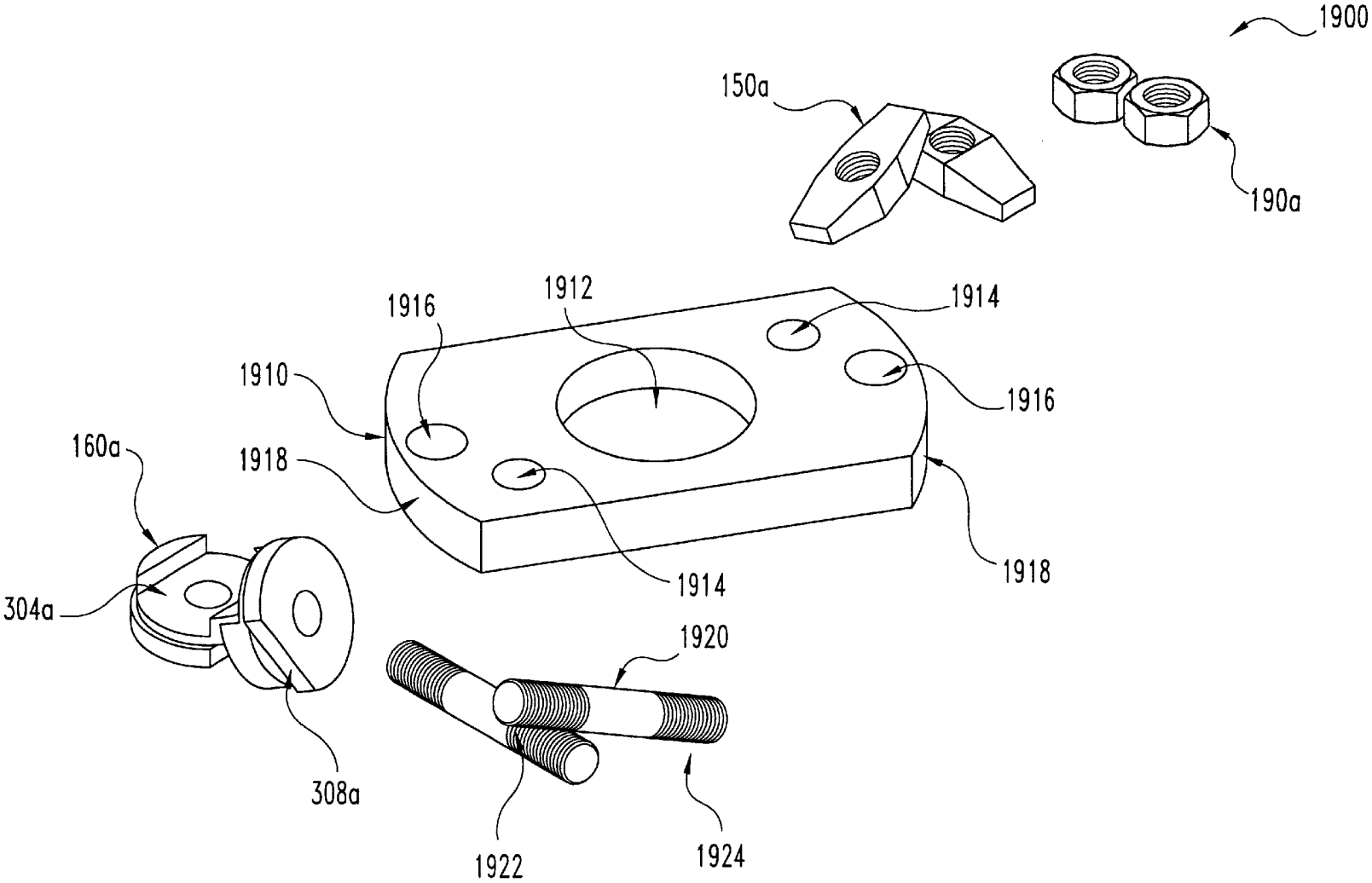
FIG. 19 is a perspective view of a tooling adapter kit for removing camshaft gears according to stillyet another embodiment of the present invention.

An adapter kit 1900 according to a further embodiment of the present invention is illustrated in FIG. 19. The adapter kit 1900 is used in conjunction with the tooling kit 100 in order to accommodate a large jack that has enough power to remove a small camshaft gear. Adapter kit 1900 includes a base 1910, two base studs 1920, two jaw members 150*a*, two retainers 160*a*, and two nuts 190*a*. The jaw members 150*a*, retainers 160*a*, and nuts 190*a* have the same configuration as the above-described components 150, 160 and 190 except they are smaller in order to engage smaller camshaft gears. Base 1910 has defined therein a central bore 1912, a pair of base stud mounting holes 1914, and a pair of stud mounting holes 1916. The base stud mounting holes 1914 are located radially closer to the central bore 1912, as compared to the stud mounting holes 1916, so that the adapter kit 1900 can attach to the smaller camshaft gears. The base 1910 further has arcuate outer edges 1918. Each base stud 1920 has threaded end portions 1922 and 1924 at each end.

Figure 20:
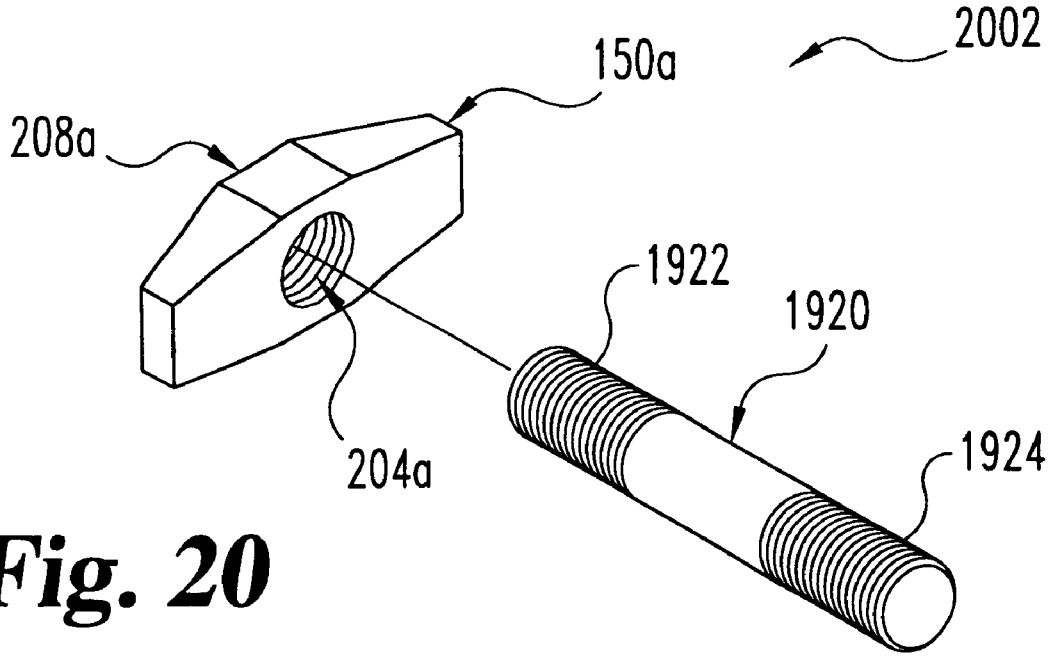
FIG. 20 is an exploded perspective view of a base jaw-stud assembly showing one stage in a removal procedure utilizing the adapter kit of FIG. 19.
Figure 21:
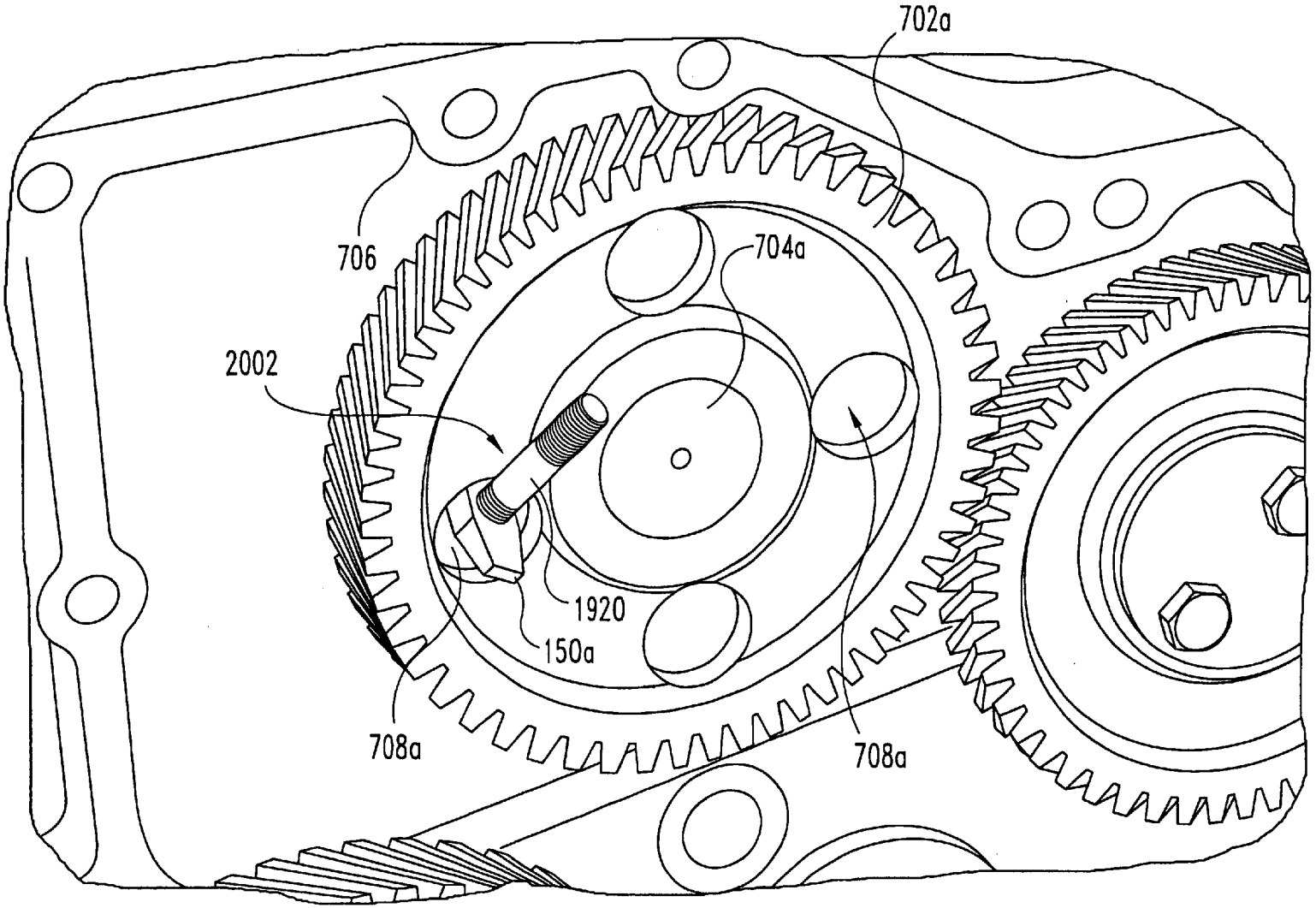
FIG. 21 is a perspective view of an engine along with the base jaw-stud assembly showing additional stages in the removal procedure utilizing the adapter kit of FIG. 19.

As illustrated in FIG. 20, the threaded end portion 1922 of the base stud 1920 is fastened to threaded bore 204*a* in the jaw member 150*a*. When combined, the jaw member 150*a* and the base stud 1920 form a base jaw-stud assembly 2002. The base jaw-stud assembly 2002 in FIG. 21 is angled through blanking hole 708*a* in gear 702*a*. The base jaw-stud assembly 2002 is maneuvered sideways until the jaw member 150*a* is fully inserted through the blanking hole 708*a*. The other base jaw-stud assembly 2002 is likewise inserted into an opposite blanking hole 708*a*. After insertion, the jaw-stud assemblies 2002 are centered in their respective blanking holes 708*a*.

Figure 22:
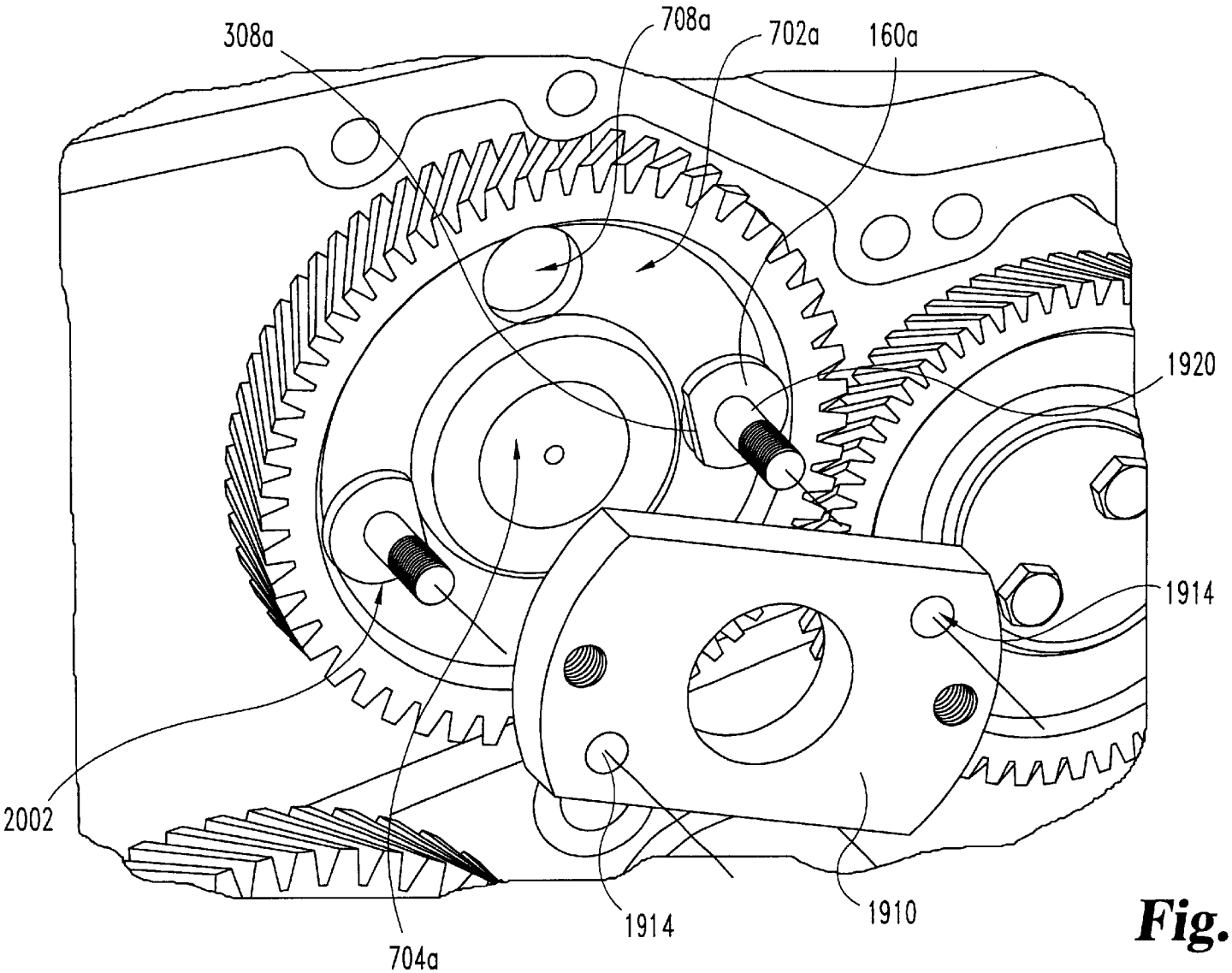
FIG. 22 is a perspective, exploded view of the jaw-stud assemblies and the base shown in FIG. 19 illustrating additional stages in the removal procedure utilizing the adapter kit of FIG. 19.

Retainers 160*a* in FIG. 22 are then slid down the studs 1920 until the retainers 160*a* are positioned within the blanking holes 708*a*. The jaw member receiving cavity 304*a* for each retainer 160*a* (see FIG. 19) is positioned to engage the corresponding jaw member 150*a*. After the jaw member 150*a* is engaged, the indicator face 308*a* of the retainer 160*a* is rotated to face the camshaft 704*a*. This ensures that the jaw member 150*a* is properly positioned on the back of the camshaft gear 702*a* so as to minimize the risk of damage to the gear 702*a* and/or the adapter kit 1900. With the jaw-stud assemblies 2002 held in place, the base studs 1920 are then slid through the base stud mounting holes 1914 defined in the base 1910.

Figure 23:
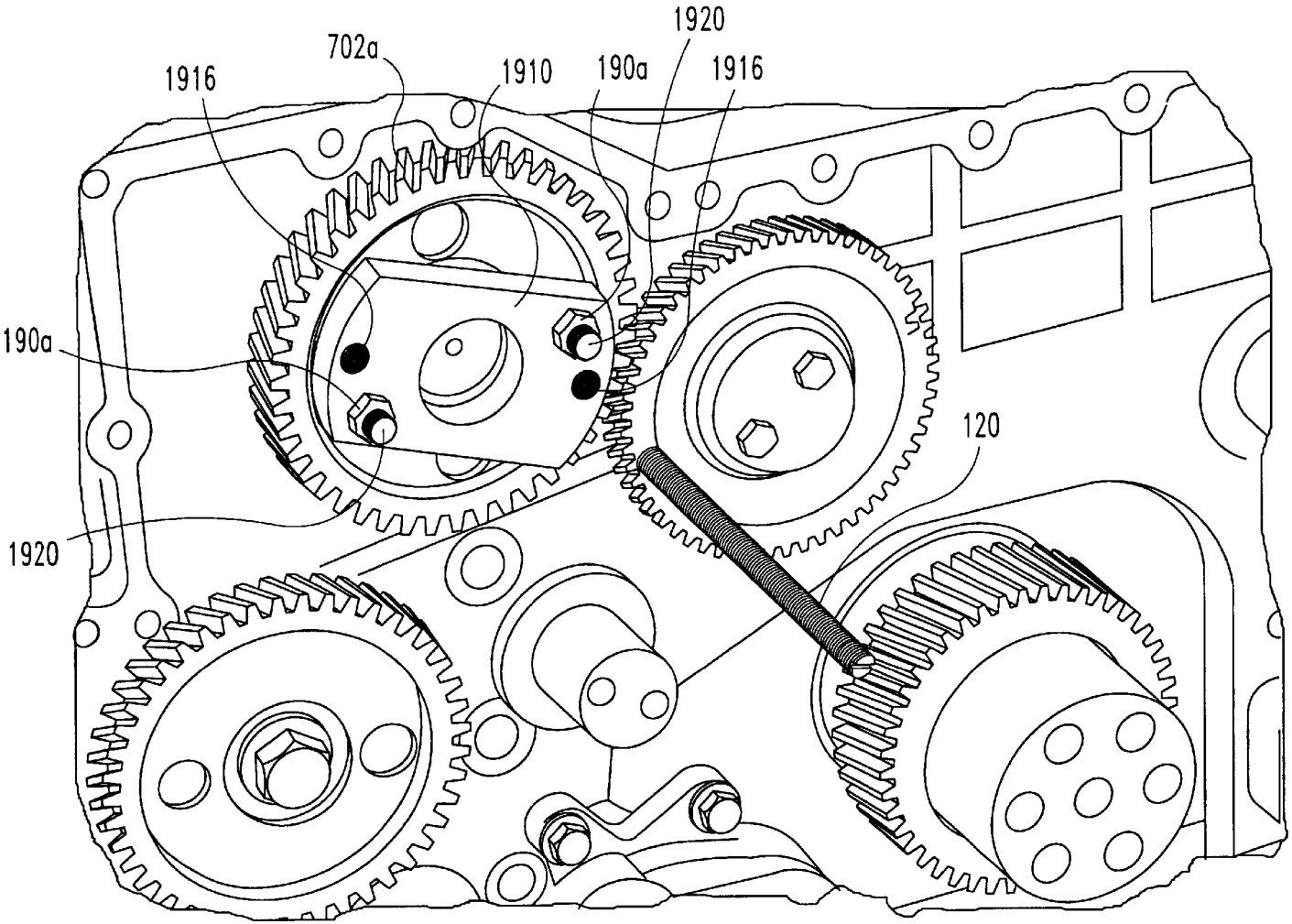
FIG. 23 is a perspective view of the engine showing additional stages in the removal procedure utilizing the adapter kit of FIG. 19.
Figure 24:
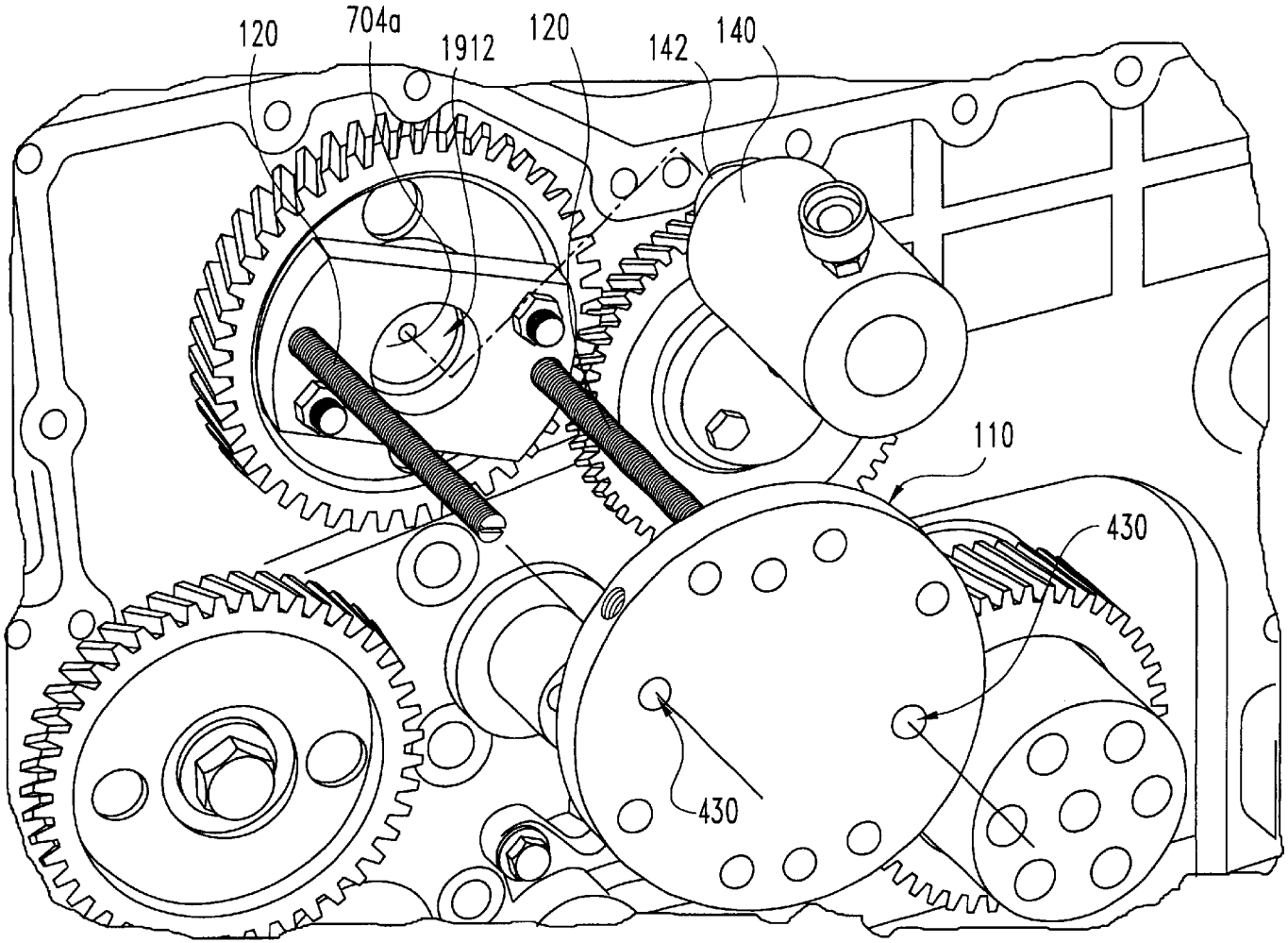
FIG. 24 is a perspective, exploded view of the assembled adapter kit along with the jack and removal plate shown in FIG. 1 illustrating additional stages in the removal procedure utilizing the adapter kit of FIG. 19.

As depicted in FIG. 23, base nuts 190*a* are threaded onto the base studs 1920 to secure the base 1910 to the gear 702*a*. Two of the fully threaded studs 120 are then threadedly secured to the two threaded stud mounting holes 1916 in the base 1910. The studs 120 are completely threaded into the mounting holes 1916 so as to prevent stripping. As shown in FIG. 24, the jack 140 is centered over the central bore 1912 between the two studs 120 and is supported from falling. The diameter of the central bore 1912 is substantially equal to the diameter of the camshaft 704*a* so that the piston 142 of the jack 140 is unobstructed. The removal plate 110 is then mounted onto the two studs 120 by sliding the two studs 120 through the mounting holes 430 defined in the plate 110, and the jack 140 is centered in the jack-receiving cavity 402 of the removal plate 110 (see FIG. 12).

Figure 25:
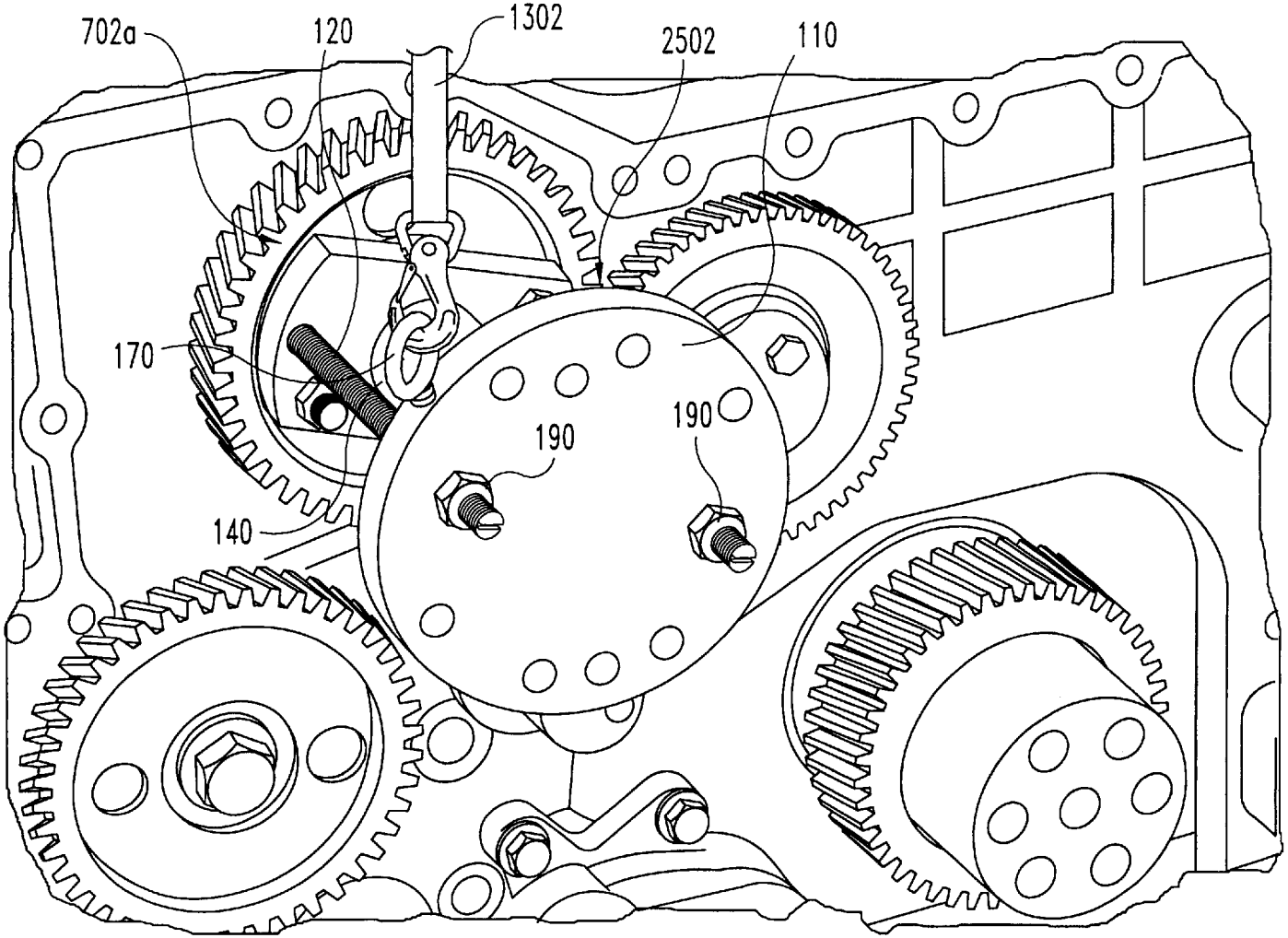
FIG. 25 is a perspective view of the assembled kit showing additional stages in the removal procedure utilizing the adapter kit of FIG. 19.

Nuts 190 in FIG. 25 are then threaded and secured to the studs 120 in order to secure the plate 110. Eyebolt 170 is then secured to the plate 110, and the lifting device 1302 is attached to the eyebolt 170 so as to support assembled kit 2502. The lifting device 1302 can slightly lift assembled kit 2502 in order to align the piston rod 142 of the jack 140 with the central bore 1912 and the camshaft 704*a*. After the piston rod 142 is aligned, the jack 140 is energized by the pump 1404 in order to remove the assembled kit 2502 and the gear 702*a* from the camshaft 704*a* (see FIGS. 14–16). Once the removal of the camshaft gear 702 is completed, kits 100 and 1900 can be stored until needed for another similar task.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A kit of tooling components for facilitating removal of a gear having blanking holes from a shaft, said kit comprising:

a plurality of jaw members which are constructed and arranged to fit through the blanking holes of the gear and to engage the gear;

a jack which is constructed and arranged to exert force on the shaft;

a plate which is constructed and arranged to brace said jack;

a set of studs which are constructed and arranged to transmit force exerted on said plate by said jack onto said jaw members;

a set of base studs which are constructed and arranged to attach to said jaw members; and a base which is constructed and arranged to couple said studs to said base studs.

2. The kit of claim 1, further comprising a plurality of retainers which are constructed and arranged to fit inside and align said set of base studs in the blanking holes.

3. The kit of claim 2, wherein said retainers each have a jaw member-receiving cavity defined therein for engaging said jaw members, a retaining flange extending therefrom and an indicator face defined therein for indicating jaw member alignment.

4. The kit of claim 1, wherein said base has defined therein a central bore adapted to receive a portion of said jack, a plurality of base stud mounting holes adapted to receive said base studs, and a plurality of threaded stud mounting holes adapted to attach said studs to said base.

5. The kit of claim 1, further comprising:

a plurality of nuts to attach said studs to said plate; and a plurality of base nuts to attach said base studs to said base.

6. A kit of tooling components for facilitating removal of a gear having blanking holes from a shaft, said kit comprising:

plurality of jaw members which are constructed and arranged to fit through the blanking holes of the gear and to engage the gear;

a jack which is constructed and arranged to exert force on the shaft;

a plate which is constructed and arranged to brace said jack;

a set of studs which are constructed and arranged to transmit force exerted on said plate by said jack onto said jaw members; and a plurality of retainers which are constructed and arranged to fit inside and align said set of studs in the blanking holes.

7. The kit of claim 6, wherein said retainers each have a jaw member-receiving cavity defined therein for engaging one of said jaw members, a flange extending therefrom and an indicator face defined thereon for indicating jaw member alignment.

8. The kit of claim 6, further comprising a plurality of nuts to attach said studs to said retainers.

9. The kit of claim 6, wherein:

said retainers and said set of studs are separate components; and said retainers are constructed and arrange to be received on said set of studs.

10. A kit of tooling components for facilitating removal of a gear having blanking holes from a shaft, said kit comprising:

a plurality of jaw members which are constructed and arranged to fit through the blanking holes of the gear and to engage the gear;

a jack which is constructed and arranged to exert force on the shaft;

a plate which is constructed and arranged to brace said jack;

a set of studs which are constructed and arranged to transmit force exerted on said plate by said jack onto said jaw members;

a spacer base which is constructed and arranged to attach to said jack; and a spacer which is constructed and arranged to attach to said spacer base.

11. The kit of claim 10, further comprising:

a plurality of spacer base cap screws adapted to fasten said spacer base to said jack; and a spacer cap screw adapted to fasten said spacer to said spacer base.

12. A kit of tooling components for facilitating removal of a gear having blanking holes from a shaft, said kit comprising:

a plurality of jaw members which are constructed and arranged to fit through the blanking holes of the gear and to engage the gear;

a jack which is constructed and arranged to exert force on the shaft;

a plate which is constructed and arranged to brace said jack;

a set of studs which are constructed and arranged to transmit force exerted on said plate by said jack onto said jaw members; and wherein said jaw members each has a threaded bore defined therein and opposing tapered portions extending therefrom.

13. The kit of claim 12, further comprising a plurality of nuts adapted to fasten said studs to said plate.

14. The kit of claim 12, further comprising an eyebolt which is constructed and arranged to support said plate during removal of the gear.

15. The kit of claim 12, wherein said plate has at least two sets of holes defined therein that are adapted to receive said studs, each of said sets of holes being located on said plate in different orientations to accommodate different gear types.

16. The kit of claim 12, wherein said plate has a jack-receiving cavity defined therein adapted to receive and center said jack over the shaft.

17. The kit of claim 16, wherein said jack includes a hydraulic cylinder.

18. The kit of claim 12, further comprising:

an adapter kit including a set of base studs constructed and arranged to attach to said jaw members, a base constructed and arranged to attach to said base studs, said base defining a central bore over the shaft; and wherein said studs are constructed and arranged to attach to said base for transmitting the force exerted on said plate by said jack onto said jaw members through said base and said base studs.

19. The kit of claim 18, wherein said adapter kit includes a plurality of retainers constructed and arranged to fit inside in the blanking holes and to orient said jaw members on the gear.

20. The kit of claim 19, wherein said retainers each has a jaw member-receiving cavity defined therein for engaging one of said jaw members, a flange extending therefrom and an indicator face defined thereon for indicating jaw member alignment.

21. The kit of claim 18, wherein:

said base defines a plurality of holes constructed and arranged to receive said base studs; and said adapter kit includes a plurality of nuts constructed and arranged to secure said base studs to said base.

22. A kit of tooling components for facilitating removal of a gear having blanking holes from a shaft, said kit comprising:

a plurality of jaw members which are constructed and arranged to fit through the blanking holes of the gear and to engage the gear;

a jack which is constructed and arranged to exert force on the shaft;

a plate which is constructed and arranged to brace said jack;

a set of studs which are constructed and arranged to transmit force exerted on said plate by said jack onto said jaw members;

a spacer base which is constructed and arranged to attach to said jack;

a spacer which is constructed and arranged to attach to said spacer base;

a plurality spacer base cap screws adapted to fasten said spacer base to said jack;

a spacer cap screw adapted to fasten said spacer to said jack;

a plurality of retainers which are constructed and arranged to fit inside and align said set of studs in the blanking holes, wherein said retainers each includes a jaw member-receiving cavity defined therein for engaging one of said jaw members, a retaining flange extending therefrom and an indicator face defined therein for indicating jaw member alignment;

a plurality of nuts which are constructed and arranged to attach said studs to said plate and to attach said retainers to said studs;

wherein said plate has at least two sets of holes with each of said sets of holes corresponding to a different gear type, said plate further having a jack-receiving cavity defined therein adapted to receive said jack;

wherein said jaw members each has a threaded bore defined therein and opposing tapered portions extending therefrom; and wherein said jack includes a hydraulic cylinder.

23. A method of removing a gear having blanking holes from a shaft, comprising:

providing a kit of tooling components including a plurality of jaw members, a plurality of studs, a plate, and a jack;

coupling the studs to the jaw members;

inserting the jaw members through the blanking holes in the gear;

aligning the jack with the shaft;

attaching the studs to the plate with the jack positioned between the plate and the shaft;

wherein said removing the gear from the shaft by extending the jack wherein said coupling includes attaching a set of base studs to a base and the jaw members; and attaching the base to the studs.

24. A method of removing a gear having blanking holes from a shaft, comprising:

providing a kit of tooling components including a plurality of jaw members, a plurality of studs, a plate, and a jack;

coupling the studs to the jaw members;

inserting the jaw member through the blanking holes in the gear;

positioning retainers in the holes by sliding respective retainers along each of the studs, wherein each of the retainers has a jaw-member engaging cavity and an indicator face defined thereon;

engaging the jaw-member engaging cavities with the jaw members;

rotating the indicator faces of the retainers to face the shaft;

securing the retainers to the jaw-members;

aligning the jack with the shaft;

attaching the studs to the plate with the jack positioned between the plate and the shaft; and removing the gear from the shaft by extending the jack.

25. The method of claim 24, wherein said coupling includes attaching the studs directly to the jaw members.

26. The method of claim 24, wherein said attaching includes fastening the studs to the plate with nuts.

27. The method of claim 24, wherein:

the jaw members each has a threaded bore defined therein and opposing tapered portions extending therefrom;

each of the studs is threaded;

said coupling includes threading the jaw members onto the studs; and said inserting includes angling the tapered portions of the jaw members through the blanking holes.

28. A method of removing a gear having blanking holes from a shaft, comprising:

providing a kit of tooling components including a plurality of jaw members, a plurality of studs, a plate, and a jack;

coupling the studs to the jaw members;

inserting the jaw members through the blanking holes in the gear;

aligning the jack with the shaft;

attaching the studs to the plate with the jack positioned between the plate and the shaft;

removing the gear from the shaft by extending the jack;

wherein said attaching includes securing a spacer base to the jack; and securing a spacer to the spacer base.

29. The method of claim 28, further comprising:

wherein said coupling includes fastening the studs directly to the jaw members;

positioning retainers in the holes by sliding the respective retainers along each of the studs, wherein each of the retainers has a jaw-member engaging cavity and an indicator face defined thereon;

engaging the jaw-member engaging cavities with the jaw members;

rotating the indicator faces of the retainers to face the shaft;

securing the retainers to the jaw-members with nuts; and wherein said attaching the studs to the plate includes fastening the studs to the plate with nuts.

* * * * *